US007472960B1

(12) United States Patent
Kuehn

(10) Patent No.: US 7,472,960 B1
(45) Date of Patent: Jan. 6, 2009

(54) RECYCLABLE EVENT CHAIR

(76) Inventor: Thomas M. Kuehn, 2790 Stratford La. SW., #3124, Tumwater, WA (US) 98512

( * ) Notice: Subject to any disclaimer, the term of this patent is extended or adjusted under 35 U.S.C. 154(b) by 458 days.

(21) Appl. No.: 11/274,844

(22) Filed: Nov. 14, 2005

Related U.S. Application Data

(60) Provisional application No. 60/628,276, filed on Nov. 17, 2004.

(51) Int. Cl.
*A47C 7/00* (2006.01)

(52) U.S. Cl. ..... 297/440.12; 248/174

(58) Field of Classification Search ..... 297/440.12; 248/174
See application file for complete search history.

(56) References Cited

U.S. PATENT DOCUMENTS 2,049,659 A * 8/1936 Parrott ..... 297/440.12
3,331,634 A * 7/1967 Harrison, Jr. ..... 297/440.12
4,085,970 A 4/1978 Klein
4,546,941 A * 10/1985 Hildebrand ..... 248/174
4,556,253 A 12/1985 Geneve et al.
4,648,658 A 3/1987 Calco
4,811,987 A 3/1989 Volpe et al.
4,813,744 A 3/1989 Scalisi et al.
4,841,882 A * 6/1989 Ehrman ..... 108/115
4,984,848 A 1/1991 Scalisi et al.
5,382,081 A * 1/1995 Henry ..... 297/440.12
5,445,435 A * 8/1995 Sheckles ..... 297/440.12
5,580,131 A 12/1996 Ribot
5,795,027 A 8/1998 Howard et al.
5,860,704 A 1/1999 Smith

* cited by examiner

*Primary Examiner*—Anthony D Barfield
(74) *Attorney, Agent, or Firm*—Brian J. Coyne

(57) ABSTRACT

A foldable, recyclable chair for stadium event patrons. First and second longitudinal score lines divide a pre-scored, pre-cut blank into left and right longitudinally-extended, mirror-image sections joined by a central section. The central section comprises five quadrilateral panels joined in tandem at transverse score lines, the topmost comprising two triangular panels joined by a trapezoidal panel. The left and right sections each comprise, in descending order, an upper flap panel, a rectangular array of triangular panels defined by intersecting diagonal score lines that join opposite corners of the rectangular array; a first trapezoidal panel that is bounded by a diagonal score line; a second trapezoidal panel joined to the first along the diagonal score line boundary thereof; and a rectangular panel joined to a lower end portion of the central section and separated from the second trapezoidal panel by a transverse cut line. The blank folds to form a chair that opens for sitting and collapses for storage. In a second version, the central section comprises seven panels joined in tandem at transverse score lines. A left longitudinal section includes an upper, four-panel assembly and a lower, two-panel assembly. The right longitudinal section is a mirror-image twin of the left.

9 Claims, 23 Drawing Sheets

RECYCLABLE EVENT CHAIR

CROSS REFERENCE TO RELATED APPLICATIONS

This application claims the benefit of U.S. Provisional Application No. 60/628,276, with filing date Nov. 17, 2004.

STATEMENT REGARDING GOVERNMENT SPONSORED RESEARCH

None

BACKGROUND OF THE INVENTION

1. Field of the Invention

This invention relates generally to economical, lightweight, recyclable and rapidly set up chairs suitable for stadium and other event seating, and more particularly to collapsible, disposable chairs that can be assembled from a single die-cut, foldable, scored blank of corrugated fiberboard or like generally planar recyclable material.

2. Prior Art

Spectators at stadium sporting events and concerts, horse and auto races, and other large gatherings often desire to have a portable chair that will provide a clean, dry and comfortable place to sit and that thereafter will collapse for compact storage for use again later or for disposal after one or more uses. To achieve light weight and low cost so as to be sufficiently inexpensive to be disposable, and preferably in a manner in which its materials can be recycled, such chairs have been assembled from foldable blanks of sheet material such as cardboard or other fiberboard and the like. Exemplary of the art in this field are the following patents: Klein U.S. Pat. No. 4,085,970; Geneve et al. U.S. Pat. No. 4,556,253; Calco U.S. Pat. No. 4,648,658; Volpe U.S. Pat. No. 4,811,987; Scalisi U.S. Pat. No. 4,713,774; Scalisi et al. U.S. Pat. No. 4,984,848; Smith U.S. Pat. No. 5,860,704; Ribot U.S. Pat. No. 5,580,131; and Howard et al. U.S. Pat. No. 5,795,027. By printing advertising on such chairs and providing an event chair to each attendee who requests one, stadium proprietors or event sponsors can acquire advertising revenue and at the same time obviate the need for event attendees to bring their own event chairs; see, for instance, Scalisi et al., U.S. Pat. No. 4,813,744 at col. 14. A significant portion of the cost of providing event chairs has been the time and labor involved in preparing the chairs for use, as the foldable blanks of the prior art event chairs have been less than ideal in that regard.

SUMMARY OF THE INVENTION

A chair foldable between a closed, collapsed storage position and an open, extended sitting position is formed by folding a single pre-cut, pre-scored blank of cardboard, fiberboard or the like. In its open, extended sitting position, the chair may be seen to include a rectangular seat, a rectangular seat back pivotally joined to a rear portion of the seat, and, triangular left and right chair sides that join the left and right sides of the seat back to the left and right sides of the seat, respectively. The left and right chair sides are each bisected by a fold or score line that extends from the apices of their triangles to an opposite side thereof, thereby permitting the seat back and seat alternately to be moved apart and together in bellows fashion through 90 degrees of pivoting rotation, corresponding to the open, extended sitting position and the collapsed position, respectively. The chair is assembled by folding a single, corner-truncated, generally rectangular body having longitudinal length preferably somewhat greater than transverse width. The term "corner-truncated" is intended to indicate that the upper left and right rectangular corner areas and lower left and right rectangular corner areas of the body are cut away from what would otherwise present an overall rectangular body outline. The body is divided into three longitudinally-extended sections of about equal transverse width by left and right longitudinal score lines—namely, a central longitudinal section; a left longitudinal section that is joined to the central longitudinal section at the left longitudinal score line; and a right longitudinal section that is joined to the central longitudinal section at the right longitudinal score line. The central section extends from an upper body margin down to a lower body margin and comprises a series of panels, denoted in descending order as trapezoidal panel (U) having a lower end joined to an upper end of panel (T) at a transverse score line 86, panel (T) joined to an upper end of panel (A) at transverse score line 20, panel (A) joined at a lower end to panel (B) at a transverse score line 18, and panel (B) joined to a panel (C) at a double transverse score line 22. Joined to left and right ends of panel (U) along diagonal score lines are triangular panels (V) and (W) such that panels (U), (V) and (W) together comprise a rectangle. The left section extends from the upper body margin down to a lower body margin and comprises a series of panels, denoted in descending order as panels (R), triangular panel (L) joined at an upper end to a lower end of panel (R) at a transverse score line 20, panel (L) being part of a quartet of panels—i.e., triangular panels (L), (J), (N) and (P)—having a common vertex that in unfolded, flat conformation together comprise a rectangular section (L, J, N, P); a lower end of the rectangular section (L, J, N, P)—namely, panel (N)—joined at a transverse score line 18 to an upper end of a trapezoidal panel (H); a trapezoidal panel (F) joined to panel (H) at a diagonal score line 41; and panel (D) separated from a lower end of panel (F) by a lower left cut line 70 and joined at the left longitudinal score line to panel (C). A diagonal score line 48 is a common end and line of joinder of panel (N) to panel (P) and of panel (J) to panel (L) A diagonal score line 44 is a common end and line of joinder of panel (J) to panel (L). The diagonal score line 48 intersects diagonal score line 44 at the common vertex of panels (L), (J), (N) and (P). The right longitudinal section is symmetrically disposed with respect to the left longitudinal section and comprises corresponding panels in descending order. That is, the right longitudinal section extends from the upper body margin down to a lower body margin and comprises a series of panels, denoted in descending order as panel (S), triangular panel (M) joined at an upper end to a lower end of panel (S) at a transverse score line 20, panel (L) being part of a quartet of panels (triangular panels (M), (Q), (O) and (K) having a common vertex) that in unfolded, flat conformation together comprise a rectangular section (M, Q, O, K); a lower end of the rectangular section (M, Q, O, K)—namely panel (O)—joined at a transverse score line 18 to an upper end of a trapezoidal panel (I); a trapezoidal panel (G) joined to panel (I) at a diagonal score line 42; and panel (E) separated from a lower end of panel (G) by a lower right cut line 72 and joined at the right longitudinal score line to panel (C). A diagonal score line 50 is a common end and line of joinder of panel (O) to panel (Q) and of panel (K) to panel (M); a diagonal score line 46 is a common end and line of joinder of panel (O) to panel (K) and panel (Q) to panel (M). Diagonal score line 46 intersects diagonal score line 50 at the common vertex of panels (M), (Q), (O) and (K). Preferably, a lower end of panel (C) has a tab extension adapted for insertion and retention within a slot centrally disposed and aligned on transverse score line 80. Adjacent panels joined at score lines are foldable with respect to each other. Accordingly, by a series of steps illustrated in the accompanying figures, the blank can be folded to assemble a recyclable event chair, wherein panels (B), (U), (V), (W), (H), (I), (F), (G), (C), (D) and (E) form the seat, panels (L), (J), (P) and (N) form the left side, panels (M), (Q), (O) and (K) form the right side, and panels (A), (R), (S) and (T) form the back of the chair. An exterior surface of panel (B) provides a suitable surface for a printed advertisement if desired.

The blank preferably further comprises a left trapezoidal flange panel (X) joined to a left end of panel (P) at a longitudinal score line 92 and a trapezoidal right flange panel (Y) joined to a right end of panel (Q) at a longitudinal score line 94, wherein the flange panels (X) and (Y) each have diagonal upper margins that are parallel to diagonal score lines 48 and 50, respectively. When the blank is folded, flange (X) partially overlies panel (H) and flange (Y) partially overlies panel (G), thereby forming part of the seat of the chair.

In an alternate embodiment of the invention, a pre-cut, pre-scored blank is provided for a chair foldable between a closed, collapsed storage position and an open, extended sitting position. The blank, when completely unfolded to a flat conformation, comprises a foldable, elongated body that extends longitudinally from an upper end margin to an opposite lower end margin and transversely from a left margin to a right margin. The blank has a central, longitudinally-extended section that includes a rectangular panel (A), a rectangular panel (B) joined to a lower end of panel (A) along a first transverse score line; a rectangular panel (C) joined to a lower end of panel (B) along a second transverse score line; a rectangular panel (D) joined to a lower end of panel (C) along a third transverse score line; a rectangular panel (E) joined to panel (D) along a fourth transverse score line; a rectangular panel (F) joined to a lower end of panel (E) along a fifth transverse score line; and a trapezoidal panel (G) joined to a lower end of panel (F) along a sixth transverse score line.

An upper left chair side/bottom assembly is joined to a left end of panel (B) at a first longitudinal score line, extends leftward from panel (B), and includes a right triangular panel (H), a trapezoidal panel (J), a right triangular panel (I) and a trapezoidal panel (K). The base of panel (I) is joined to a left end of panel (B) at a first longitudinal score line. The hypotenuse of panel (I) is also the hypotenuse of panel (H) to which it is joined along a diagonal score line that is preferably a double score line. An upper end of panel (I) is joined to a lower end of panel (K) at the first transverse score line. Panel (H) is further bounded by a lower left margin that extends leftward and upward from the point of intersection of the second transverse score line with the left longitudinal score line, which lower margin is further extended to form a lower margin of panel (J). Panel (J) is joined to a left end of panel (H) along a diagonal score line that is directed upward and rightward to the point of intersection of panels (H) and (I) with panel (K).

The second embodiment further includes an upper right chair side/bottom assembly that is joined to a right end of panel (B) at a second longitudinal score line, extends rightward from panel (B), and includes a right triangular panel (L), a trapezoidal panel (N), a right triangular panel (M) and a trapezoidal panel (O). The base of panel (M) is joined to a right end of panel (B) at a second longitudinal score line. The hypotenuse of panel (M) is also the hypotenuse of panel (L) to which it is joined along a diagonal score line that is preferably a double score line. An upper end of panel (M) is joined to a lower end of panel (O) at the first transverse score line. Panel (L) is further bounded by a lower right margin that extends rightward and upward from the point of intersection of the second transverse score line with the right longitudinal score line, which lower margin is further extended to form a lower margin of panel (N). Panel (N) is joined to a right end of panel (L) along a diagonal score line that is directed upward and leftward to the point of intersection of panels (L) and (M) with panel (O).

The second embodiment also includes a lower left chair side/back assembly that is joined to a left end of the panel (C) at the first longitudinal score line and extending from the second transverse score line to the third transverse score line. The lower left chair side/back assembly includes a right triangular panel (P) bounded by the first longitudinal score line, a ninth transverse score line collinear with the third transverse score line and extending leftward therefrom a distance about equal to the length of the left top margin, and a left diagonal margin that extends from the leftmost extremity of the ninth transverse score line to the junction of the second transverse score line with the first longitudinal score line. This assembly further includes a trapezoidal panel (Q) having an upper end joined to a lower end of panel (P) at a ninth transverse score line, and bounded by a left margin that extends from the junction of the ninth transverse score line with the left diagonal margin downward below the level of the fourth transverse score line but well above the level of the fifth transverse score line, a longitudinally-directed lower left cut line that extends about the same length as the left margin below the fourth transverse score line and a left bottom end that extends leftward from the lowermost point of said cut line to the lowermost point of said left margin.

The second embodiment still further includes a lower right chair side/back assembly that is joined to a right end of the panel (C) at the second longitudinal score line from the second transverse score line to the third transverse score line. The lower right chair side/back assembly includes a right triangular panel (R) bounded by the first longitudinal score line, a tenth transverse score line collinear with the third transverse score line and extending rightward therefrom a distance about equal to the length of the right top margin, and a right diagonal margin that extends from the rightmost extremity of the tenth transverse score line to the junction of the second transverse score line with the second longitudinal score line. This assembly further includes a trapezoidal panel (S) having an upper end joined to a lower end of panel (R) at a tenth transverse score line, and bounded by a right margin that extends from the junction of the tenth transverse score line with the right diagonal margin downward below the level of the fourth transverse score line but well above the level of the fifth transverse score line, a longitudinally-directed lower right cut line that extends about the same length as the right margin below the fourth transverse score line and a right bottom end that extends rightward from the lowermost point of said cut line to the lowermost point of said right margin. As in the case of the first embodiment, adjacent ones of said panels are foldable about said score lines with respect to one another.

The accompanying figures indicate the manner in which the blank of the second embodiment is to be folded to assemble a recyclable event chair. When so folded, panels (B) and (C) form the back, panels (L), (M), and (R) form the left side, panels (H), (I) and (P) form the right side, and the remainder of the panels form the seat of the chair.

BRIEF DESCRIPTION OF THE DRAWINGS

FIG. 2 is a top plan view thereof that shows panels (V) and (W) folded over onto panel (U);

FIG. 3 is a top plan view thereof that shows panels (P) and (L) folded over onto panels (N) and (J), panels (R) and (S) folded onto panel (A), and panels (M) and (Q) folded onto panels (K) and (O), respectively;

FIG. 4 is a top plan view thereof that shows panels (U) and (T) folded over onto Panels (R) and (S), and panels (U), (V) and (W) folded onto panel (B);

FIG. 5 is a frontal perspective view thereof that shows panel (T) partially folded to an upstanding position, and panels (P) and (L) partially folded onto panels (N) and (J), panels (Q) and (M) partially folded onto panels (O) and (K), and panels (F) and (G) partially folded onto panel (B), respectively;

FIG. 6 is a frontal perspective view thereof that shows the completion of the partial folding of FIG. 5;

FIG. 7 is a frontal perspective view thereof that shows panels (D) and (E) folded onto panel (C);

FIG. 8 shows panels (C), (D) and (E) folded onto panels (R) and (S), thereby completing conversion of the blank into a chair in an open, extended position; and FIG. 9 is a side elevational view of the same chair in a collapsed position;

FIG. 11 is a top plan view thereof that shows panel (C) folded onto panel (B), panel (D) folded onto panel (A), panel (P) folded onto panel (I), panel (Q) folded onto panel (K), panel Ⓡ folded onto panel (M), and panel (S) folded onto panel (O);

FIG. 12 is a top plan view thereof that shows panel (D) folded back onto panel (C);

FIG. 13 is a top plan view thereof that shows panel (H) folded onto panel (P) and panel (J) folded onto panel (Q);

FIG. 14 is a top plan view thereof that shows panel (L) folded onto panel (R) and panel (N) folded onto panel (S);

FIG. 15 is a top perspective view thereof that shows panels (H) and (L) folded to partially upstanding positions while panel (A) remains in place;

FIG. 16 is a top perspective view thereof that shows panels (J) and (N) partially folded into mating alignment to begin formation of a chair bottom, panel (Q) beginning to be folded behind panels (J) and (N), panel (S) beginning to be folded behind panel (Q);

FIG. 17 is a top perspective view thereof that shows panel panels (J) and (N) folded into planar alignment, panel (Q) folded behind panels (J) and (N), panel (S) beginning to be folded behind panel (Q), and panels (K) and (O) beginning to be folded behind panel (A);

FIG. 18 is a top perspective view thereof that shows panel (A) folded up directly behind panels (S) and (Q);

FIG. 19 is a top perspective view thereof that shows panel (D) folded over onto panels (J), (N) and (Q) and panels (K) and (O) extended and ready for folding up behind upstanding panel (A);

FIG. 20 is a top perspective view thereof that shows, after panel (K) has been folded behind panel (A) and panel (O) has been folded behind panel (K), panel (E) has been folded behind panel (K), while panels (G) and (F) remain extended rearwardly thereof;

Figure 1:
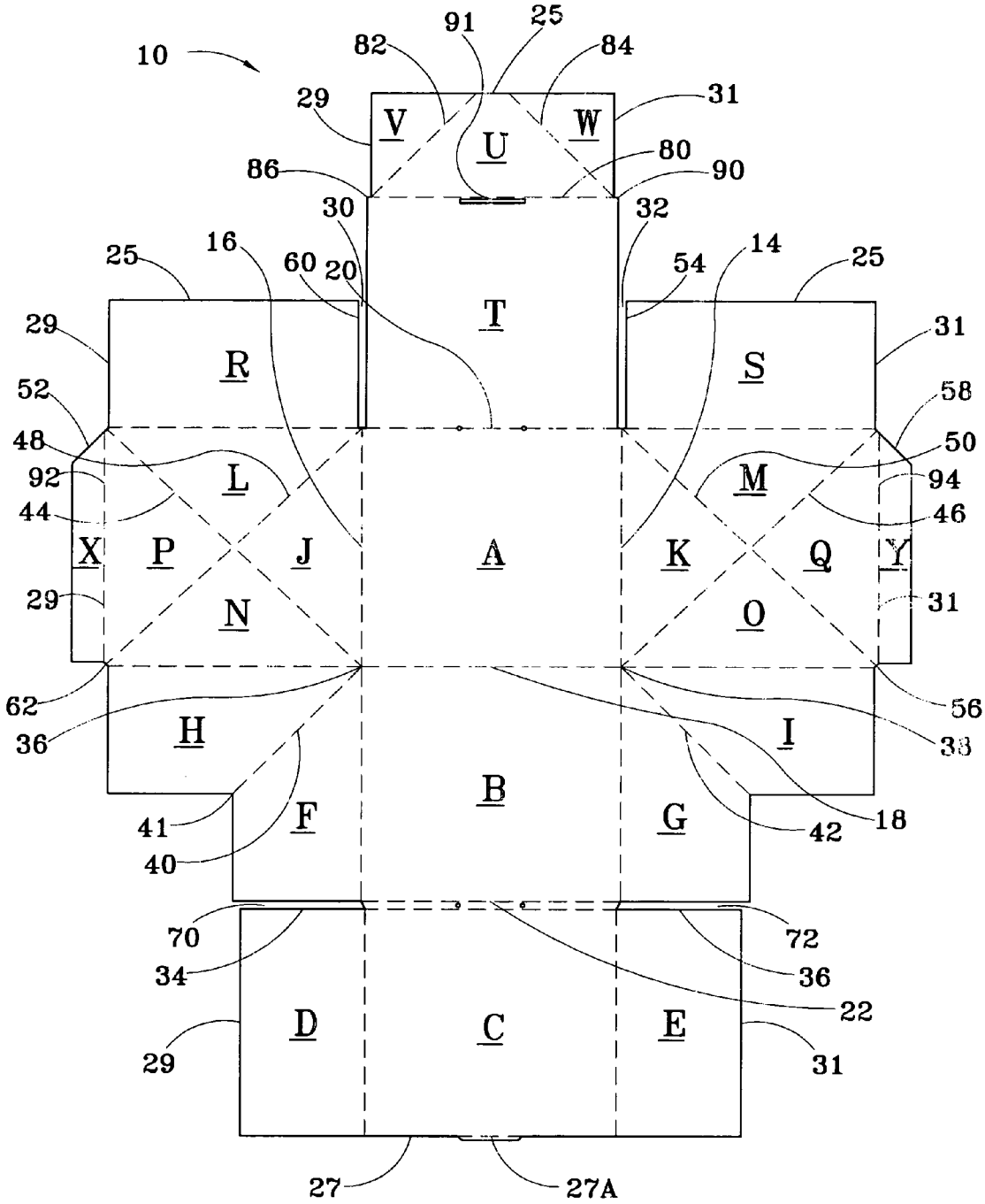
FIG. 1 is a top plan view of a pre-folded, pre-cut blank of sheet material that is foldable into a collapsible chair according to a first embodiment of the present invention, shown flat and unfolded.
Figure 10:
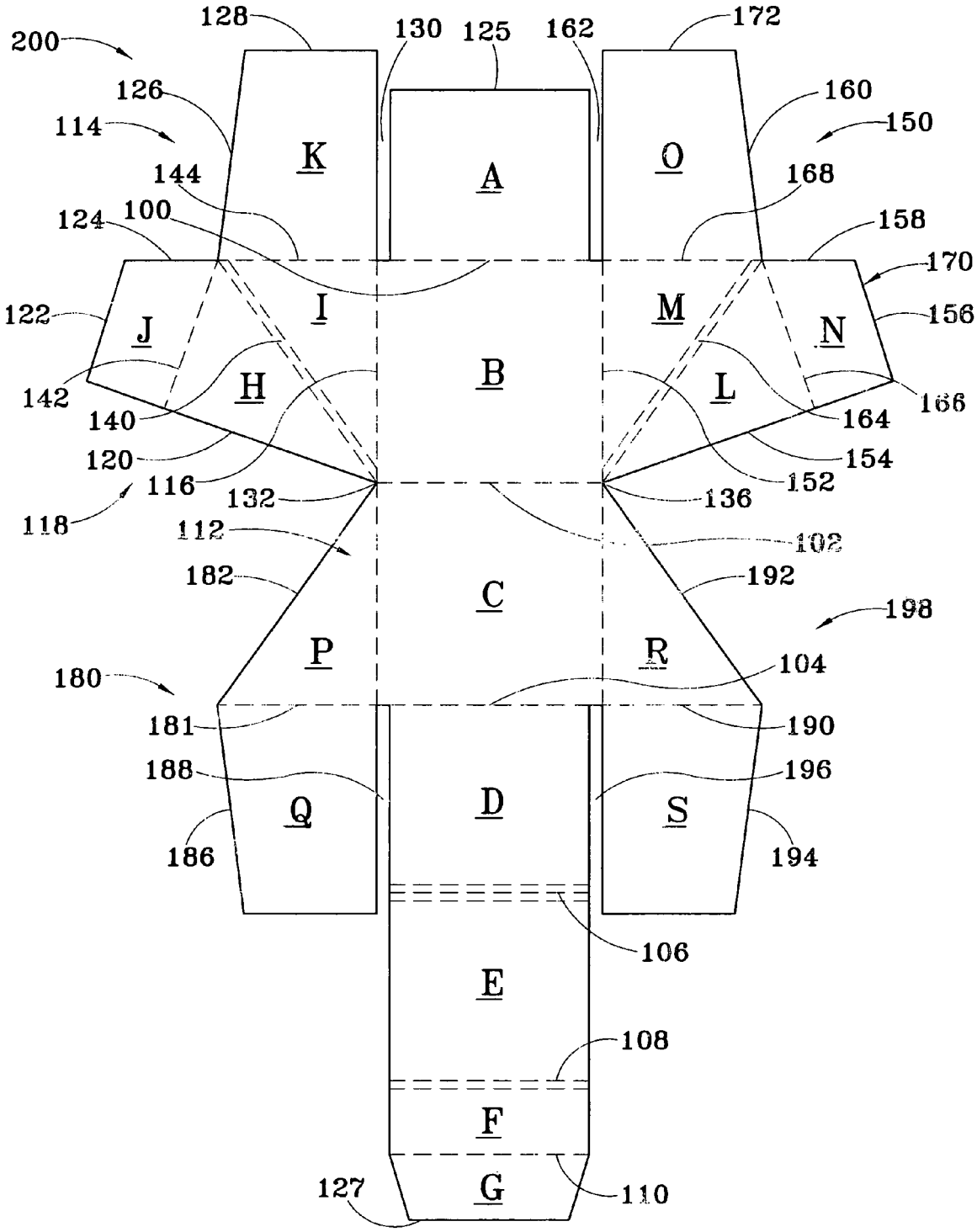
FIG. 10 is a top plan view of a pre-folded, pre-cut blank of sheet material that is foldable into a collapsible chair according to a second embodiment of the invention.
Figure 11:
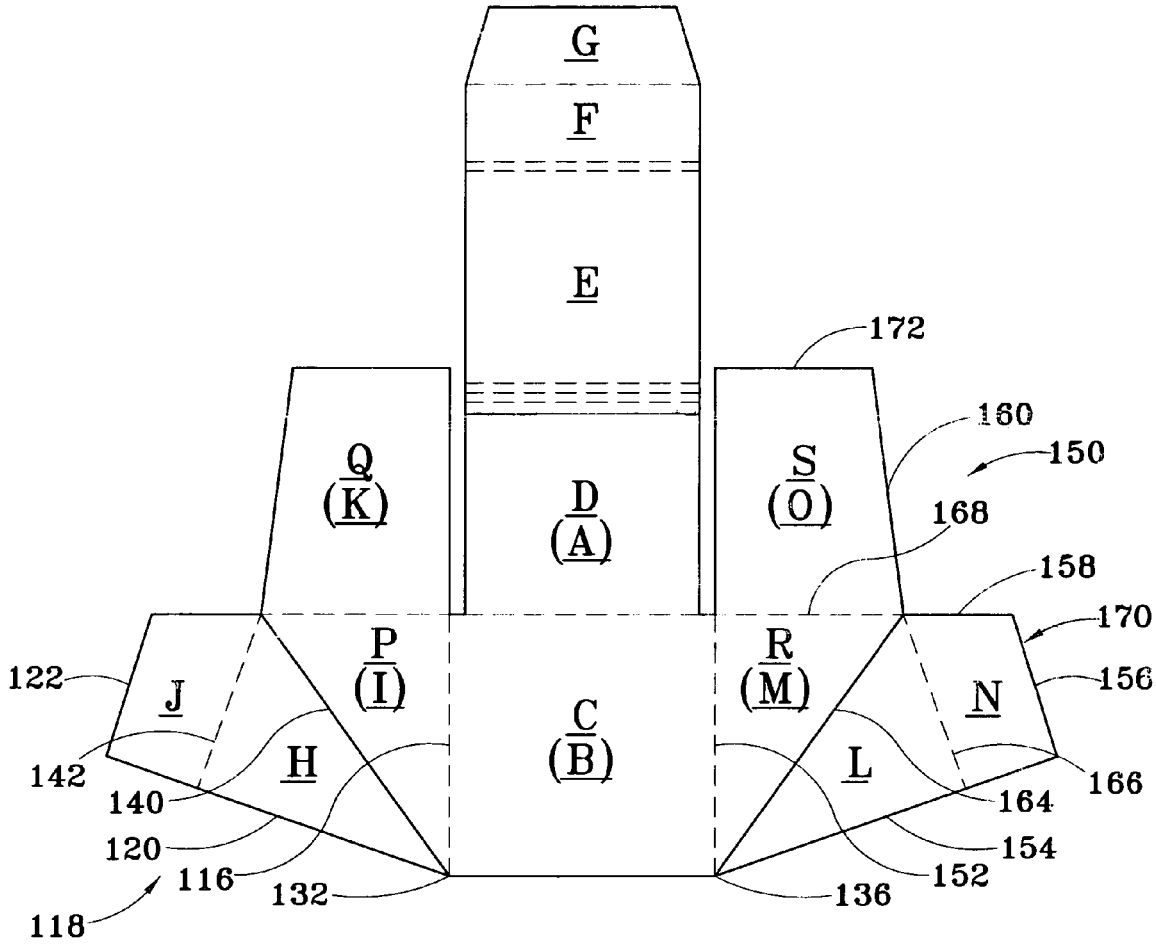
FIGS. 11-20 illustrate a sequence of steps to convert the blank of FIG. 10 into a collapsible chair.
Figure 12:
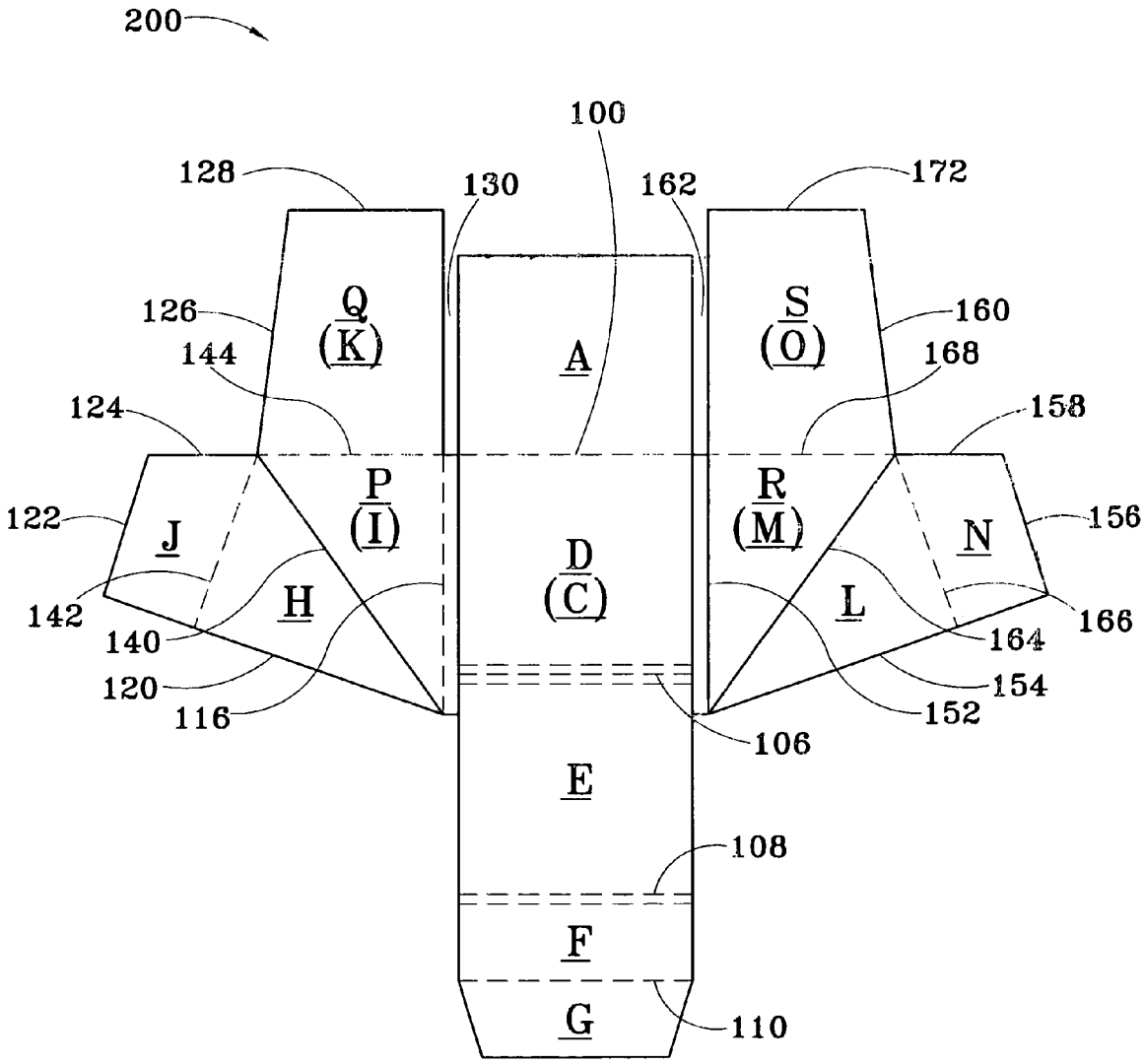
Figure 13:
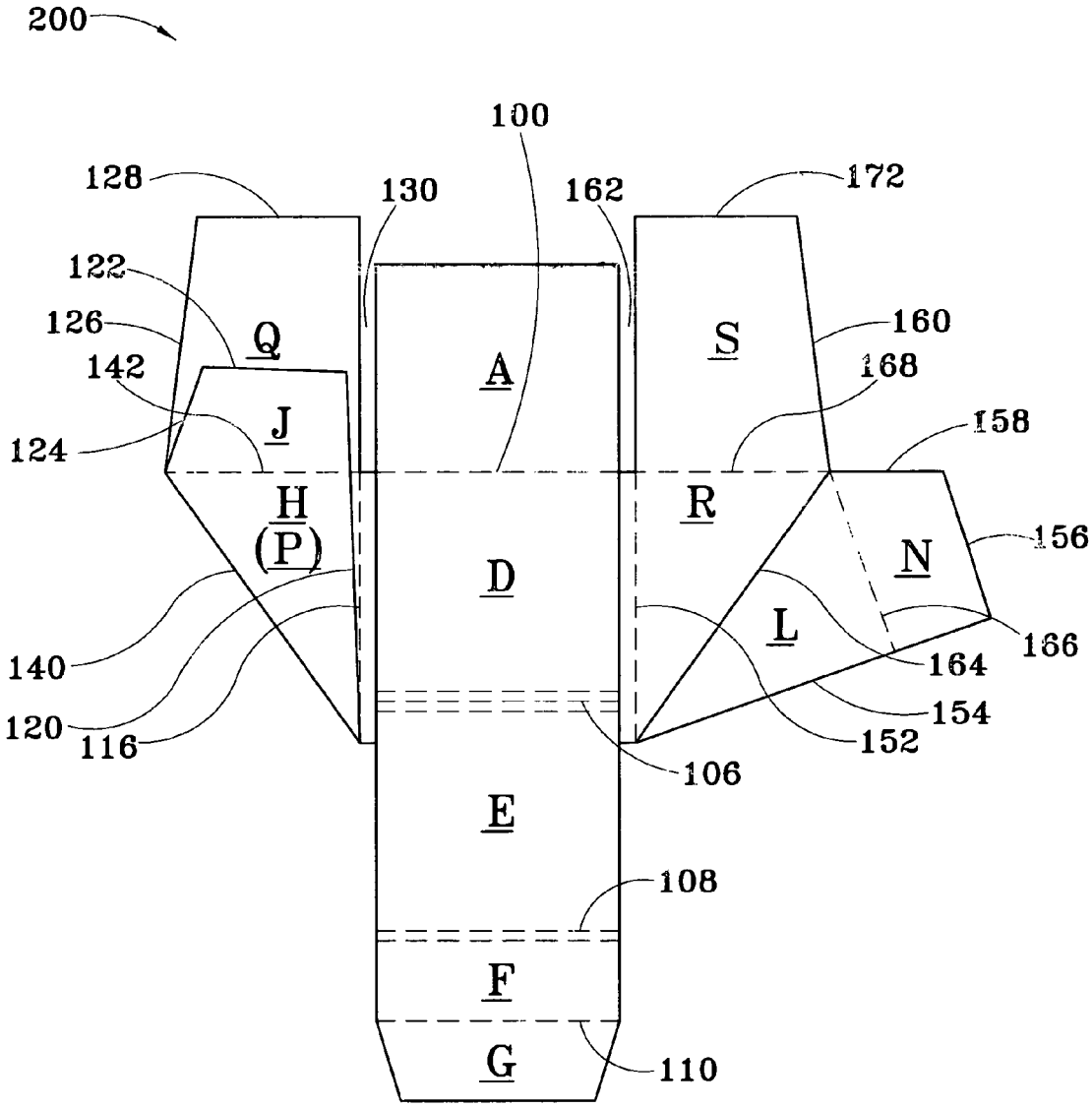
Figure 14:
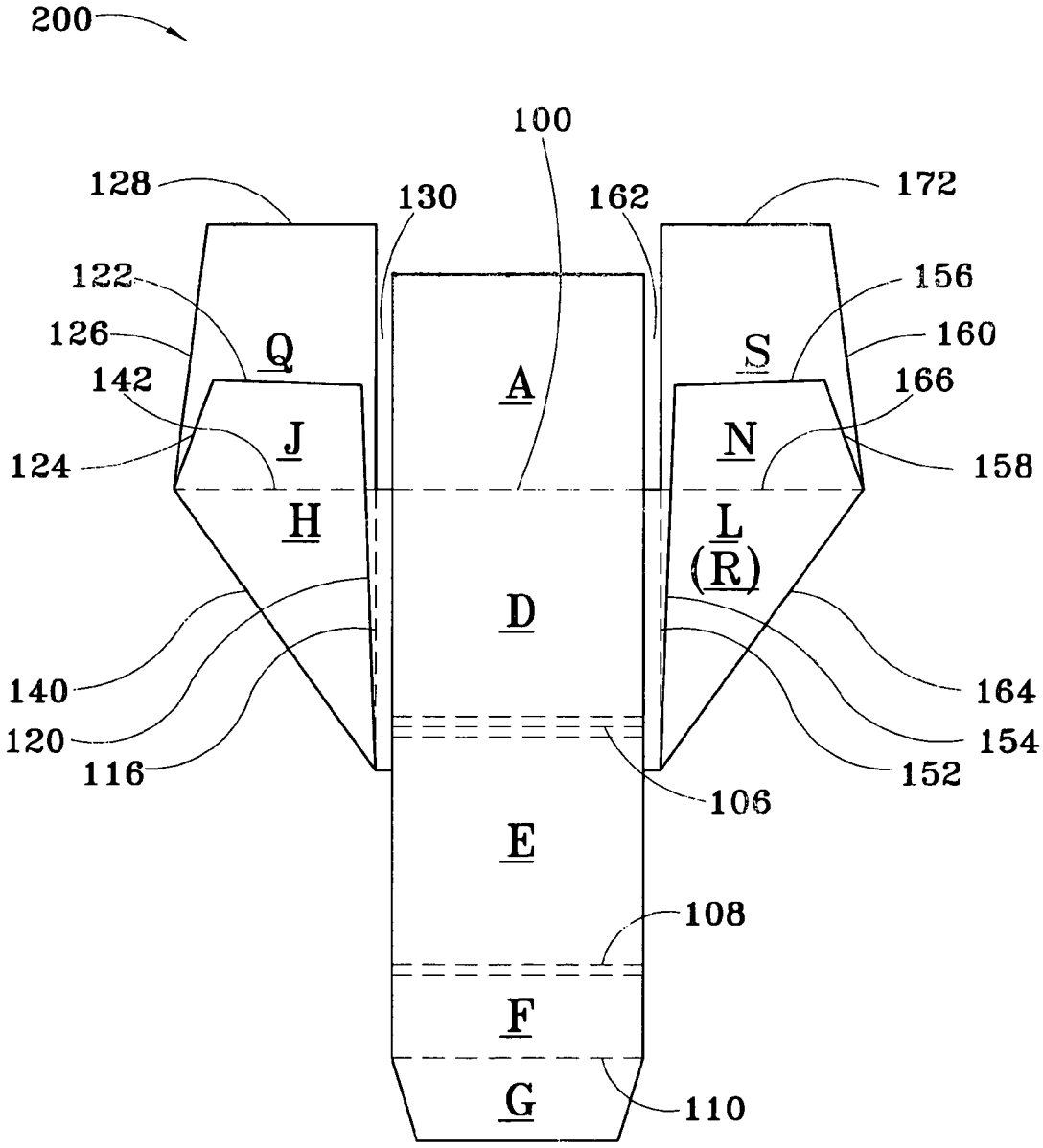
Figure 15:
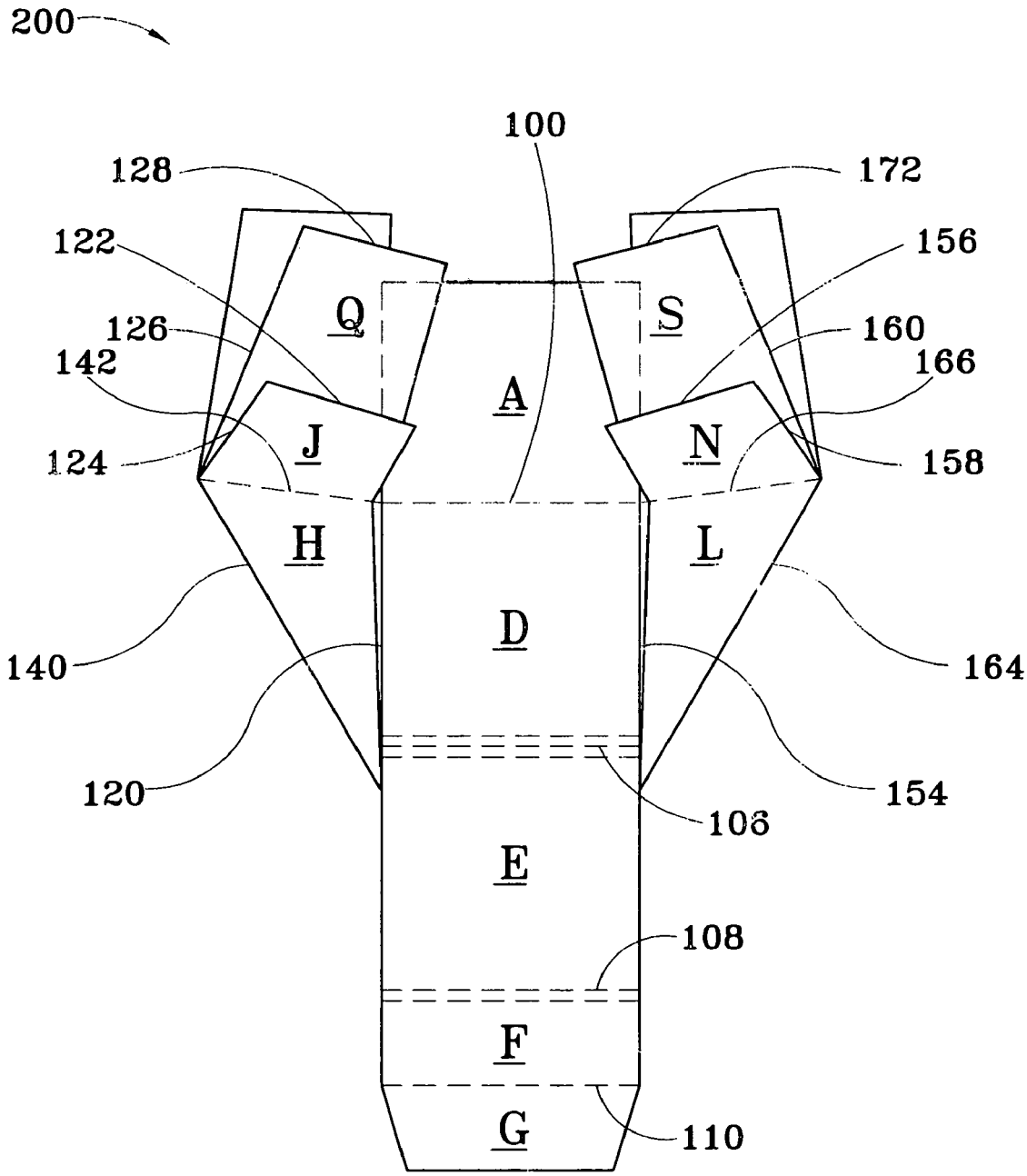
Figure 16:
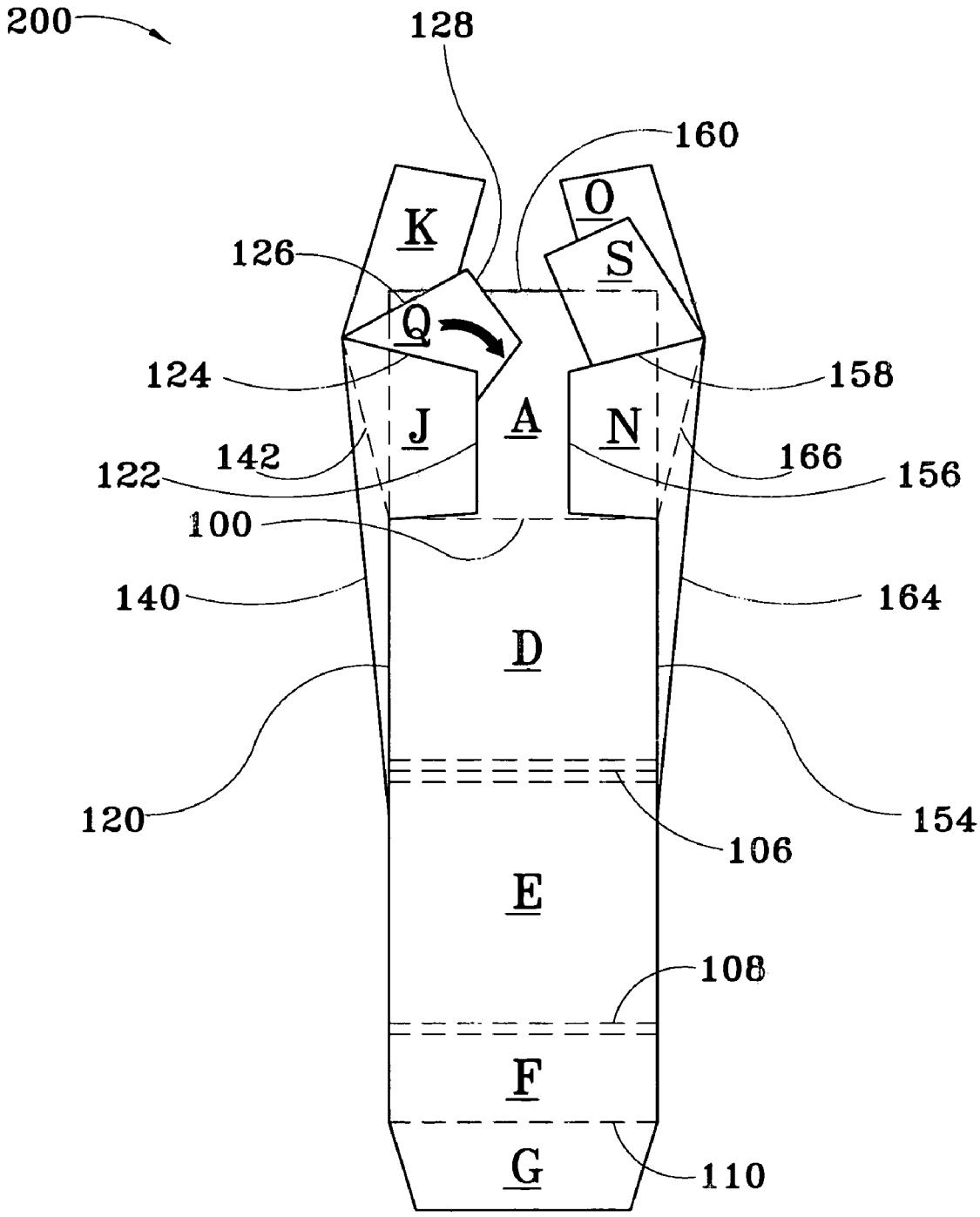
Figure 17:
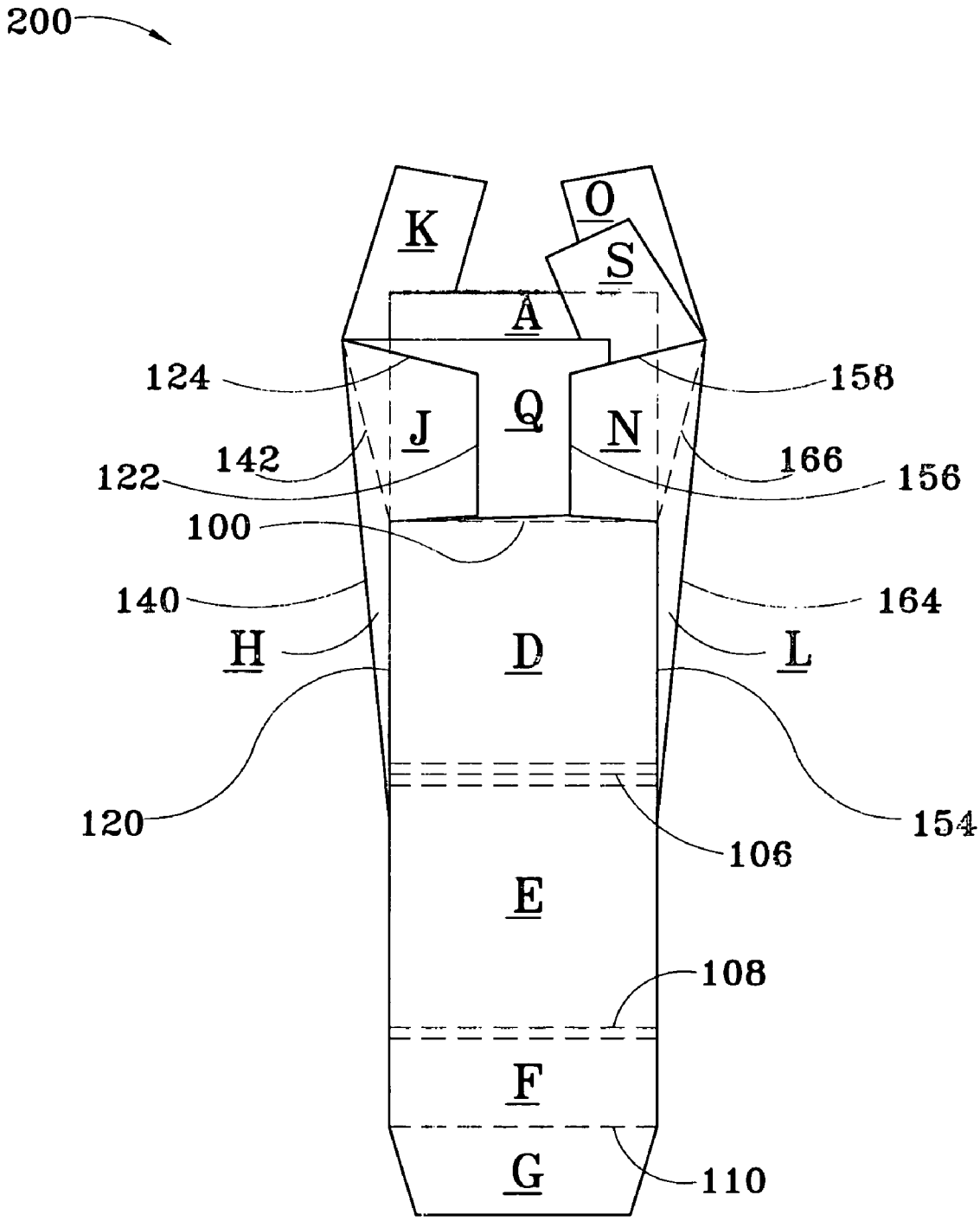
Figure 18:
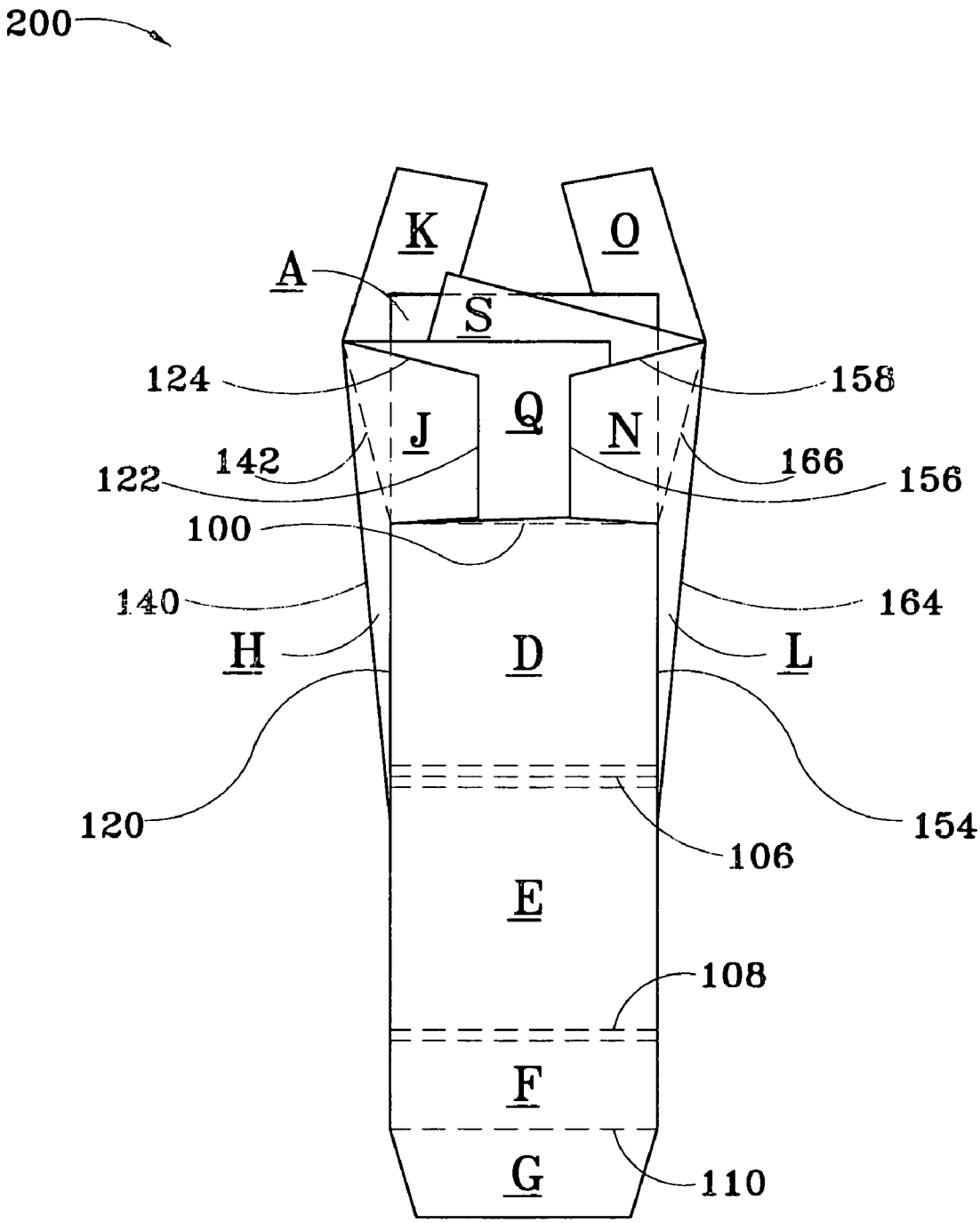
Figure 19:
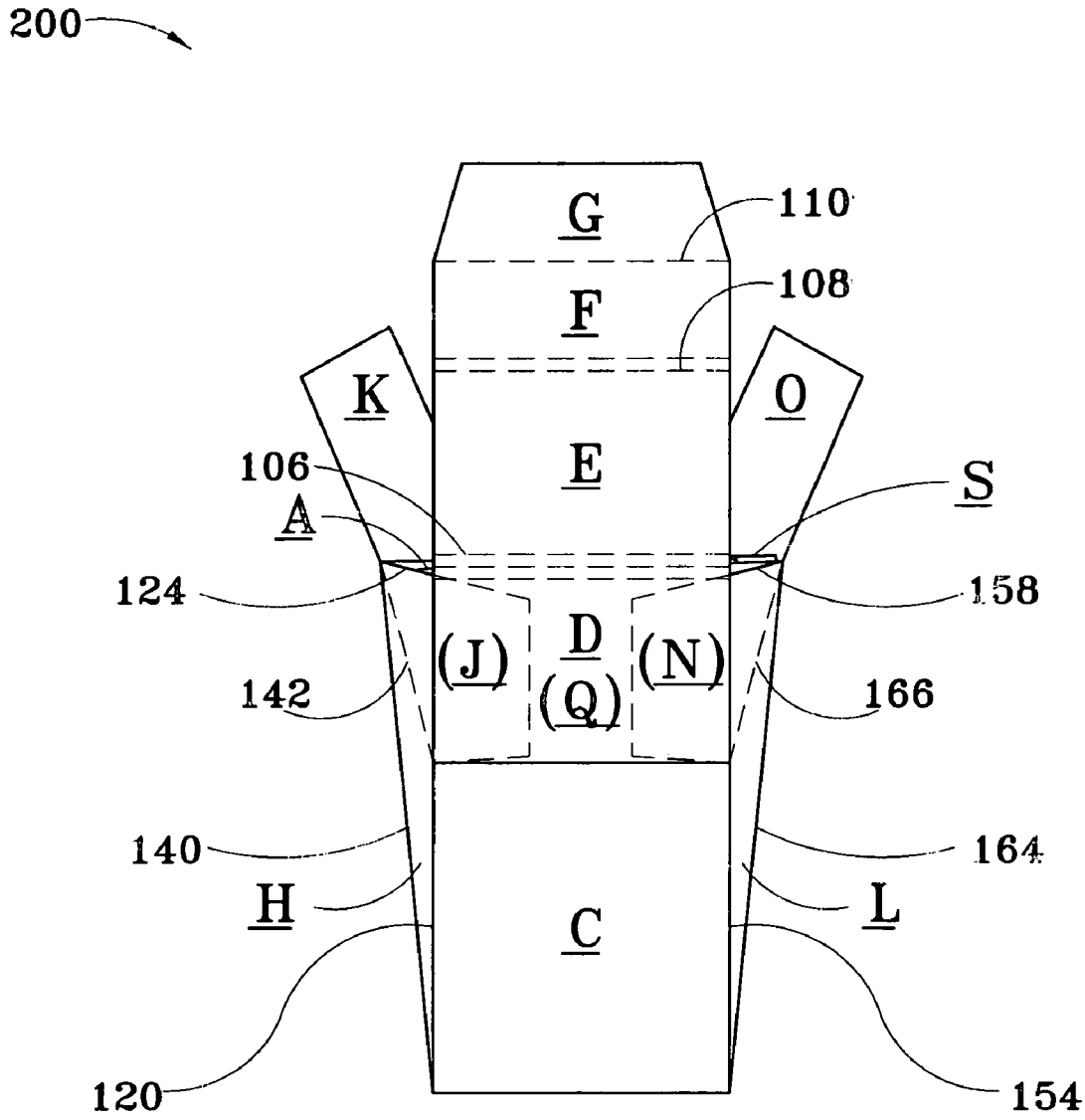
Figure 20:
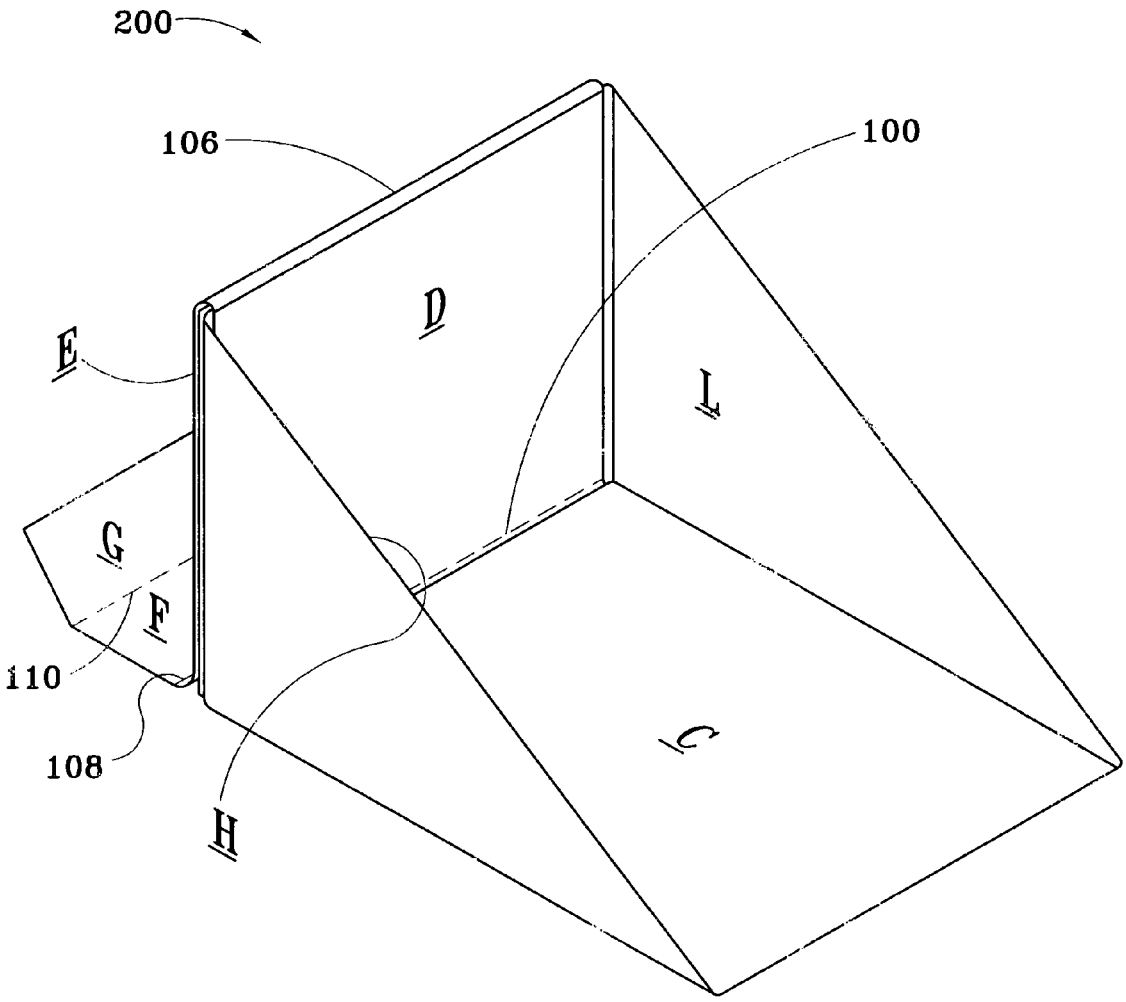

Like numerals designate similar components and aspects of the invention throughout the several figures. Panel designations shown parenthetically refer to adjacent panels hidden from view; for instance, (D) in conjunction with (Q) indicates that panel (D) has been folded over onto panel (Q). The terms "left" and "right", and "upper" and "lower," refer to the left and right sides and the upper and lower portions of the blanks 10 and 200 as depicted in FIGS. 1 and 10, respectively.

DESCRIPTION OF THE PREFERRED EMBODIMENT

The chair of the present invention is formed from a single die-cut, foldable, scored blank 10 of corrugated fiberboard or like generally planar recyclable material. The terms "scored," "score line" and "fold line" are here used interchangeably to generally describe a location that has been pre-folded or marked with lines, grooves, scratches or notches. As shown in FIG. 1, blank 10 is comprised of planar material that has the overall outline of a rectangle that is truncated at each of its four corners. That is, a rectangular, upper left corner area has been removed adjacent to a left end of the triangular, left rear seat top underflap panel (V), the left side of the rectangular, inner back panel (T), and an upper end of the rectangular, left upper flap panel (R); a rectangular, upper right corner area has been removed adjacent to a right end of the triangular, right rear seat top underflap panel (W), a right end of panel (T), and an upper end of the rectangular, right upper flap panel (S); a rectangular, lower left corner area has been removed adjacent to a lower end of trapezoidal upper left seat liner panel (H), a left end of the trapezoidal, lower left seat liner panel (F) and a left end of the rectangular, left cover flange panel (D); and a rectangular, lower right corner area has been removed adjacent to a lower end of the trapezoidal, upper right seat liner panel (I), a right end of the trapezoidal, lower right seat liner panel (G) and a right end of the rectangular, right cover flange panel (E). The blank 10 extends longitudinally from an upper end margin 25 to a lower end margin 31 and transversely from a left margin 29 to a right margin 31. The blank 10 is divided into three longitudinally-extended sections of about equal transverse width by a left longitudinal score line 16 and a right longitudinal score line 14—namely, a central longitudinal section; a left longitudinal section that is joined to the central longitudinal section at the left longitudinal score line 16; and a right longitudinal section that is joined to the central longitudinal section at the right longitudinal score line 14. The blank 10 includes the following transverse score lines: a central transverse score line 18 centrally disposed between the upper margin 25 and the lower margin 27 and extending the entire transverse width of the blank 10; a lower transverse score line 22 below the central transverse score line 31 and extending from the left longitudinal score line 16 to the right longitudinal score line 14; an upper transverse score line 20 above the central transverse score line 31 and extending entirely across the blank 10 from the left margin 29 to the right margin 31; and a top transverse score line 80 above the upper transverse score line 20 and extending across the central longitudinal section only from the left margin 29 to the right margin 31 thereof. The distances between the transverse score lines 18, 20, 22, 80 are all substantially equal and equate to the front-to-rear dimension of the seat of the chair. The lower transverse score line 22 is preferably a double score line to facilitate the folding of lower portions of the blank [panels (C), (D), (E)] in forming the chair seat. The blank 10 also has diagonal score lines as well as cut lines, which are discussed below in connection with the description of the individual panels thereof.

The central longitudinal section includes at its uppermost end a rectangular area comprised of trapezoidal panel (U) joined on its left along a seventh diagonal score line 82 to triangular underflap panel (V) and joined on its right to triangular underflap panel (V) along an eighth diagonal score line 84. Panel (U) is joined to an upper end of rectangular panel (T) along the top transverse score line 80. The left margin 29 of the triangular underflap panel (V) is collinear with the left longitudinal score line 16, as is a left, upper cut line 30 that separates the left end of the rectangular panel (T) from the left-adjacent panel (R). Likewise, the right margin 29 of triangular panel (V) is collinear with the right longitudinal score line 16, as is an upper right cut line 32 that separates the right end of the panel (T) from the right-adjacent panel (S). A lower end of panel (T) is joined along the upper transverse score line 20 to an upper end of a rectangular, outer back panel (A). A lower end of panel (A) is joined along the central transverse score line 38 to an upper end of a rectangular seat base panel (B). A lower end of panel (B) is joined along the lower transverse score line 22 to an upper end of a rectangular seat cover panel (C). Thus, panel (V) is bounded by a left margin 29, an upper margin 25 and a seventh diagonal score line 82; panel (U) is bounded by the upper margin 25, an eighth diagonal score line 84, and the top transverse score line 80; the panel (T) is bounded by the top transverse score line 80, the right margin 31 and the collinear upper right cut line 32, the upper transverse score line 20, the upper left cut line 30 and the left margin 29 with which it is collinear; the panel (A) is bounded by the upper transverse score line 20, the right longitudinal score line 14, the central transverse score line 38, and the left longitudinal score line 16; the panel (B) is bounded by the central transverse score line 38, the right longitudinal score line 14, the lower transverse score line 22, and the left longitudinal score line 16; and the panel (C) is bounded by the lower transverse score line 22, the right longitudinal score line 14, the lower margin 27, and the left longitudinal score line 16.

Proceeding from upper margin to lower margin, the left longitudinal section includes a rectangular, left upper flap panel (R) bounded by the upper transverse score line 20, the left margin 29, the upper margin 25 and the left upper cut line 30; a triangular, upper, inner left side panel (L) bounded by the upper transverse score line 20, the third diagonal score line 44, and the fifth diagonal score line 48, said panel (L) being joined to a lower end of panel (R) along the upper transverse score line 20; a triangular outer left side panel (J) bounded by the left longitudinal score line 16, the third diagonal score line 44, and the fifth diagonal score line 48, said panel (J) being joined to panel (A) along the left longitudinal score line 16, and joined to panel (L) along a fifth diagonal score line 48; a triangular, lower, outer, left side panel (N) bounded by the central transverse score line 18, the fourth diagonal score line 46, and a sixth diagonal score line 50, said panel (N) being joined to panel (J) along a third diagonal score line 44; a triangular, lower, inner left side panel (P) bounded by the left margin 29, the third diagonal score line 44, and the fifth diagonal score line 48, said panel (P) being joined to panel (L) along the third diagonal score line 44 and to panel (N) along the fifth diagonal score line 48; a trapezoidal upper left seat liner panel (H) bounded by the left margin 29, the central transverse score line 18, and the first diagonal score line 40; a trapezoidal, lower left seat liner panel (F) bounded by the lower left cut line 70 that is collinear with the lower transverse score line 22, the left margin 29, the first diagonal score line 40, and the right left longitudinal score line 16, said panel (F) being joined to a left end of panel (B) along the left longitudinal score line and to a right end of panel (H) along the first diagonal score line 40; and a rectangular left cover flange panel (D) bounded by the lower margin 27, the left margin 29, the lower left cut line 70 that is collinear with the lower transverse score line 22, and the left longitudinal score line 16.

Similarly, the right longitudinal section includes a rectangular, right upper flap panel (S) bounded by the upper transverse score line 20, the right margin 31, the upper margin 25 and the right upper cut line 32; a triangular, upper, inner right side panel (M) bounded by the upper transverse score line 20, the fourth diagonal score line 46, and the sixth diagonal score line 50, said panel (M) being joined to a lower end of panel (S) along the upper transverse score line 20; a triangular outer right side panel (K) bounded by the right longitudinal score line 14, the fourth diagonal score line 46, and the sixth diagonal score line 50, said panel (K) being joined to panel (A) along the right longitudinal score line 14, and joined to panel (M) along the sixth diagonal score line 50; a triangular, lower, outer, right side panel (O) bounded by the central transverse score line 18, the fourth diagonal score line 46, and a sixth diagonal score line 50, said panel (O) being joined to panel (K) along the fourth diagonal score line 46; a triangular, lower, inner right side panel (Q) bounded by the right margin 31, the fourth diagonal score line 46, and the sixth diagonal score line, 50 said panel (Q) being joined to panel (M) along the fourth diagonal score line 46 and to panel (O) along the sixth diagonal score line 50; a trapezoidal upper left seat liner panel (I) bounded by the right margin 31, the central transverse score line 18, and the second diagonal score line 42; a trapezoidal, lower right seat liner panel (G) bounded by the lower right cut line 72 that is collinear with the lower transverse score line 22, the right margin 31, the second diagonal score line 42, and the right longitudinal score line 14, said panel (G) being joined to a right end of panel (B) along the right longitudinal score line 14 and to a left end of panel (I) along the second diagonal score line 42; and a rectangular right cover flange panel (E) bounded by the lower margin 27, the right margin 31, the lower right cut line 72 that is collinear with the lower transverse score line 22, and the right longitudinal score line 14.

Preferably, the blank 10 further includes a trapezoidal, inner left side flange panel (X) joined to a left end of the lower, inner left side panel (P) at the third longitudinal score line 92, and a trapezoidal lower, inner right side flange panel (Y) joined to a right end of the lower, inner right side panel (Q) at a fourth longitudinal score line 94. Each of the flange panels (X, Y) extends longitudinally a distance coextensive with the panels (P, Q) to which they are joined, and said panels (X, Y) have diagonal top margins 52, 58 parallel to the fifth and fourth diagonal score lines 48, 46, respectively. The flange panels (X, Y) are desirable in that, once the blank 10 is folded to form a chair, they provide rounded surfaces instead of cut, ragged ends where the inner surfaces of the chair sides rest against the seat of the chair.

Figure 2:
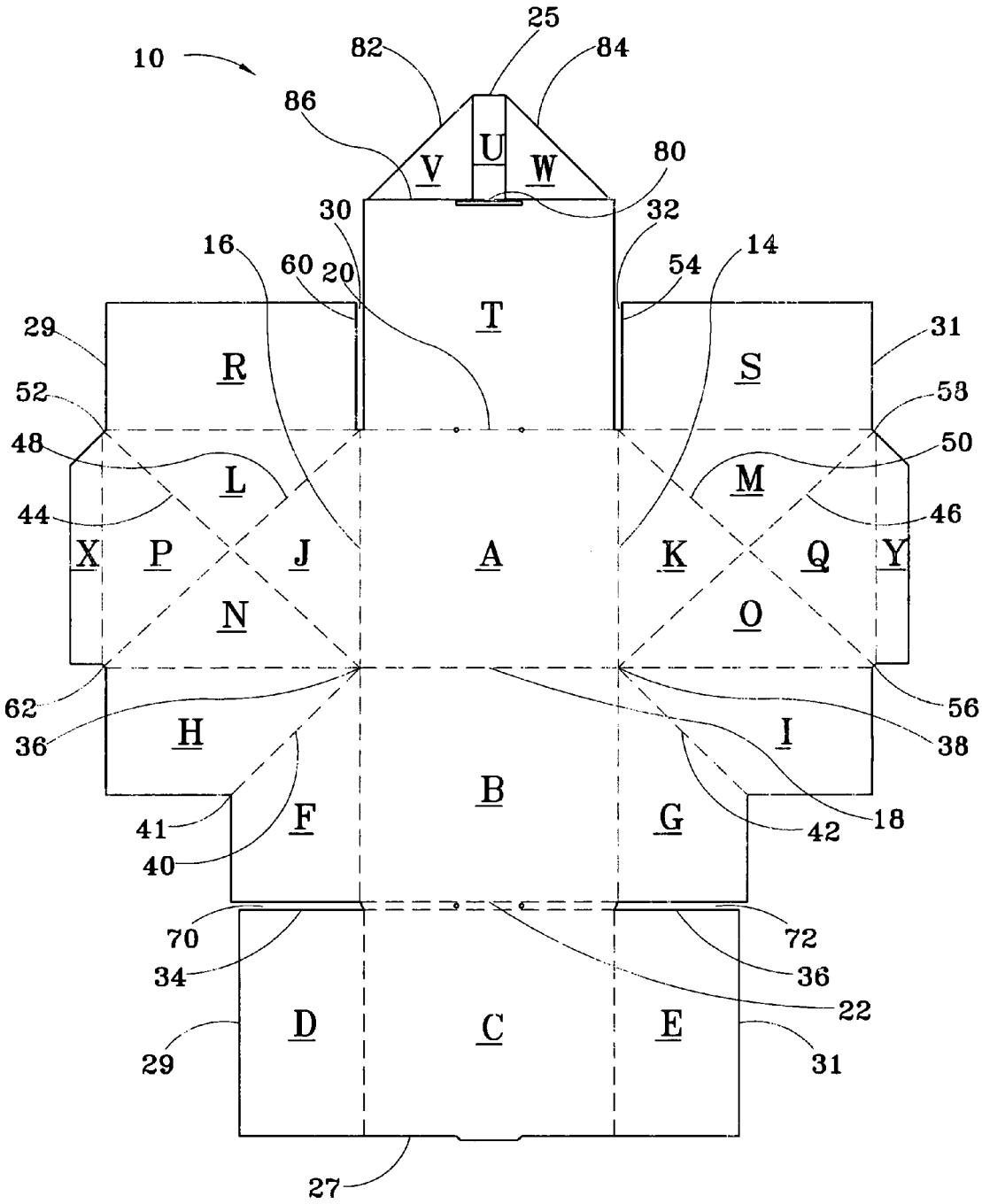
FIGS. 2-9 illustrate a sequence of steps to convert the blank of FIG. 1 into a collapsible chair.
Figure 3:
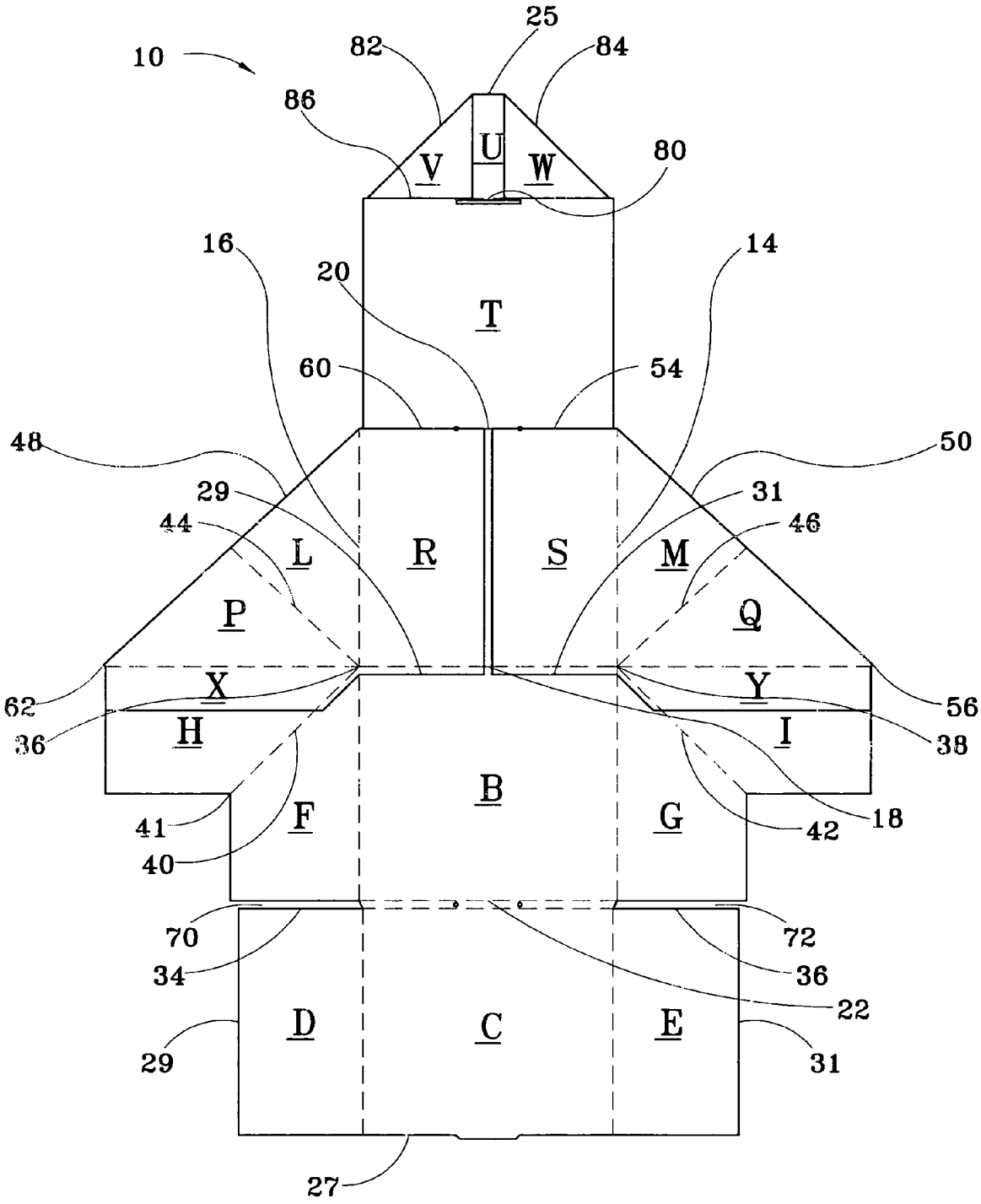
Figure 4:
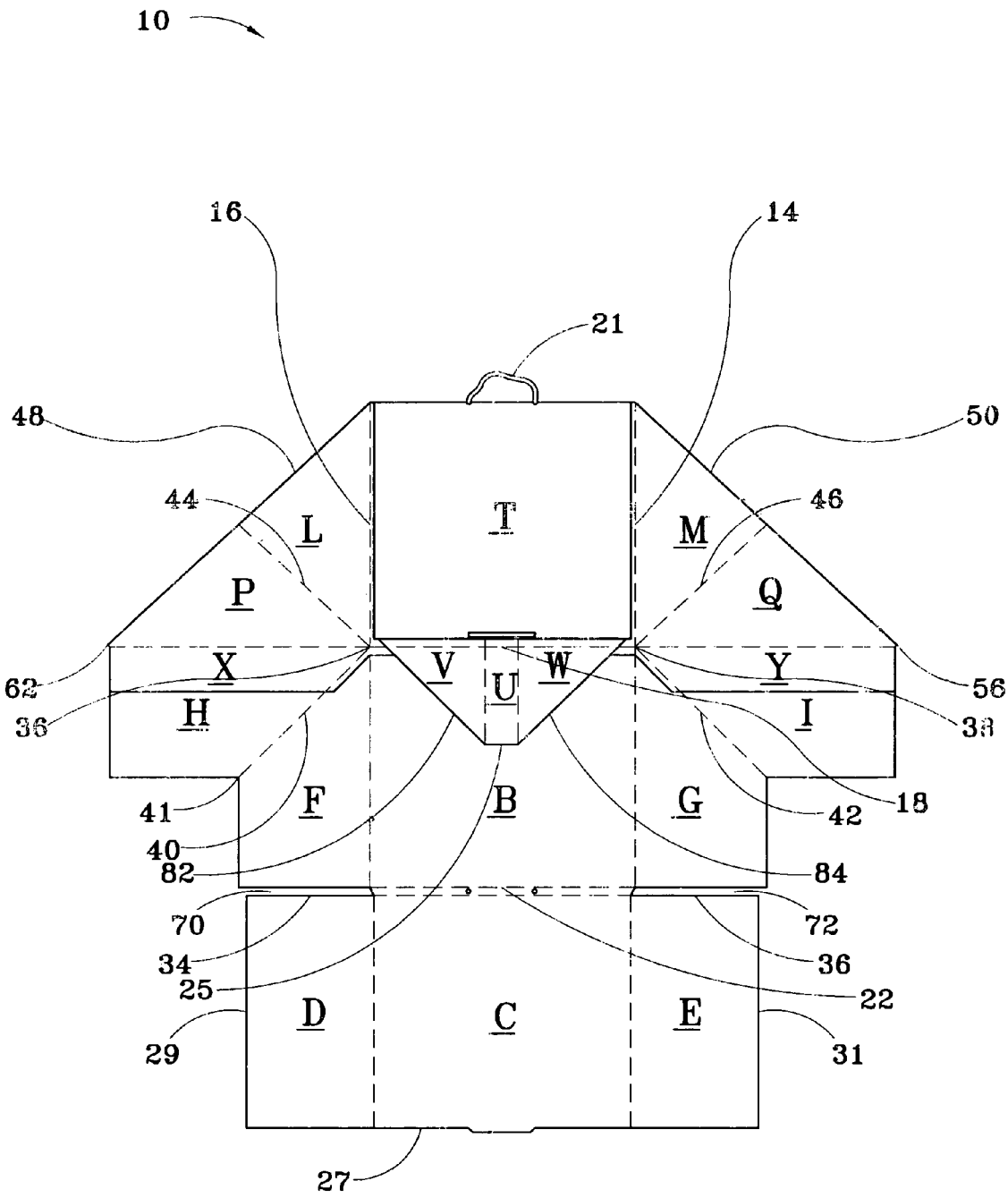
Figure 5:
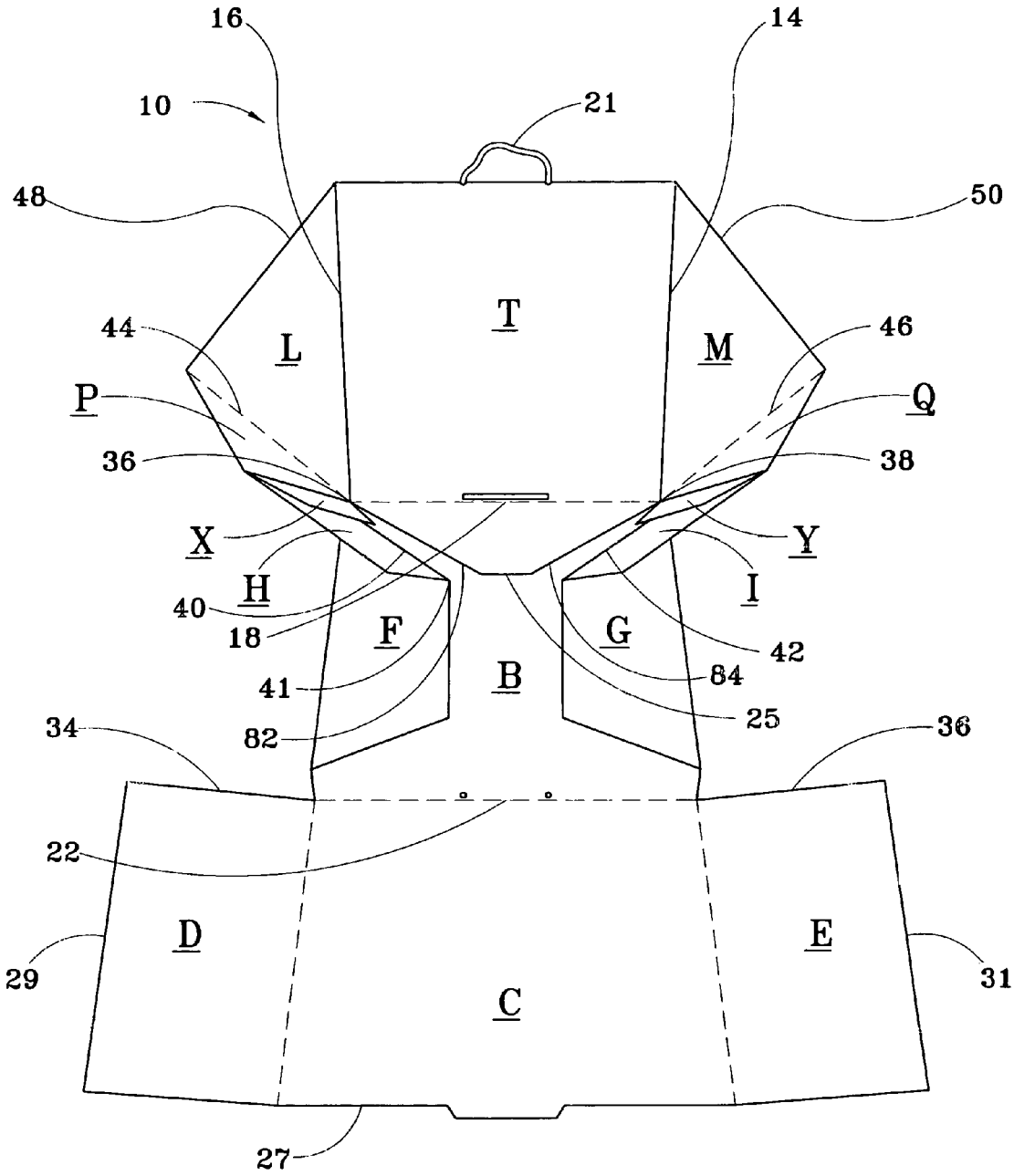
Figure 6:
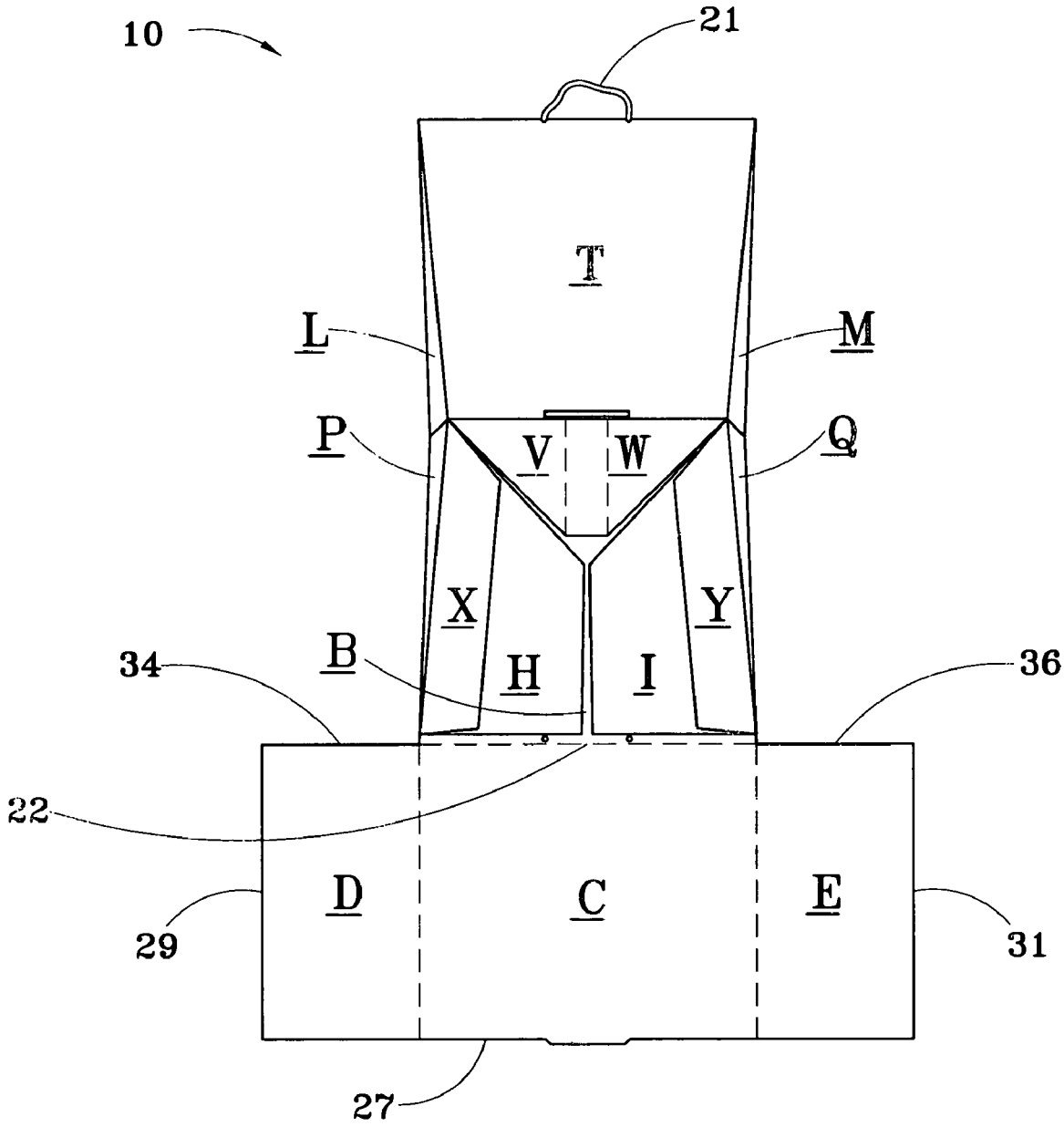
Figure 7:
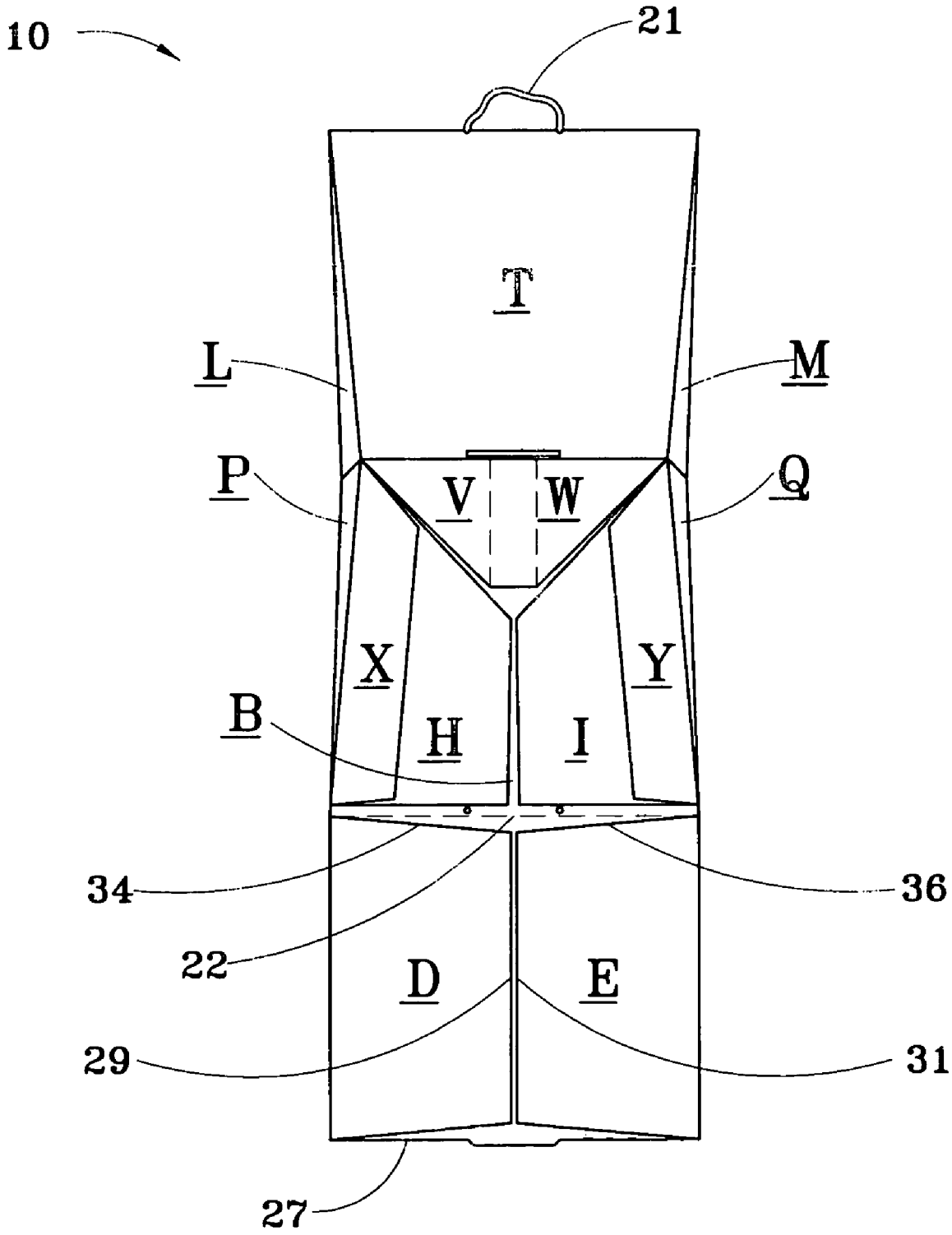
Figure 8:
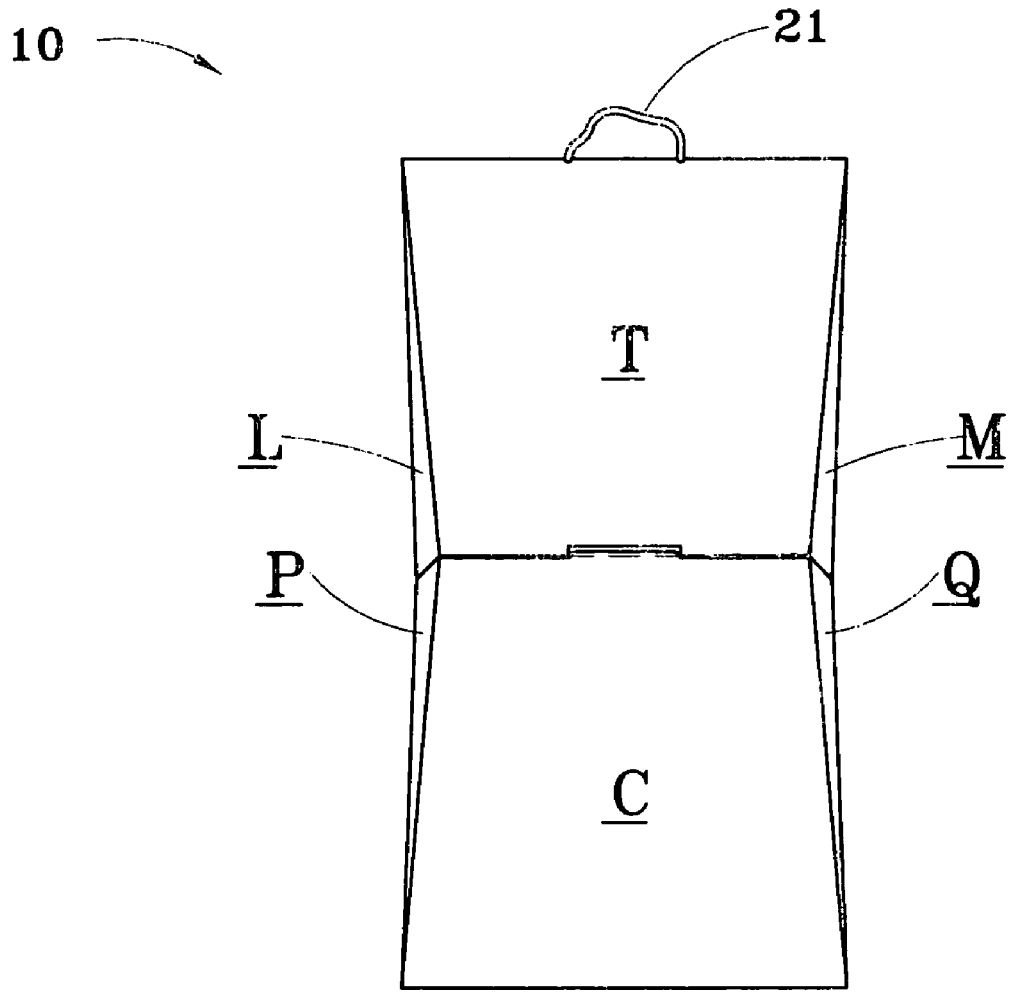
Figure 9:
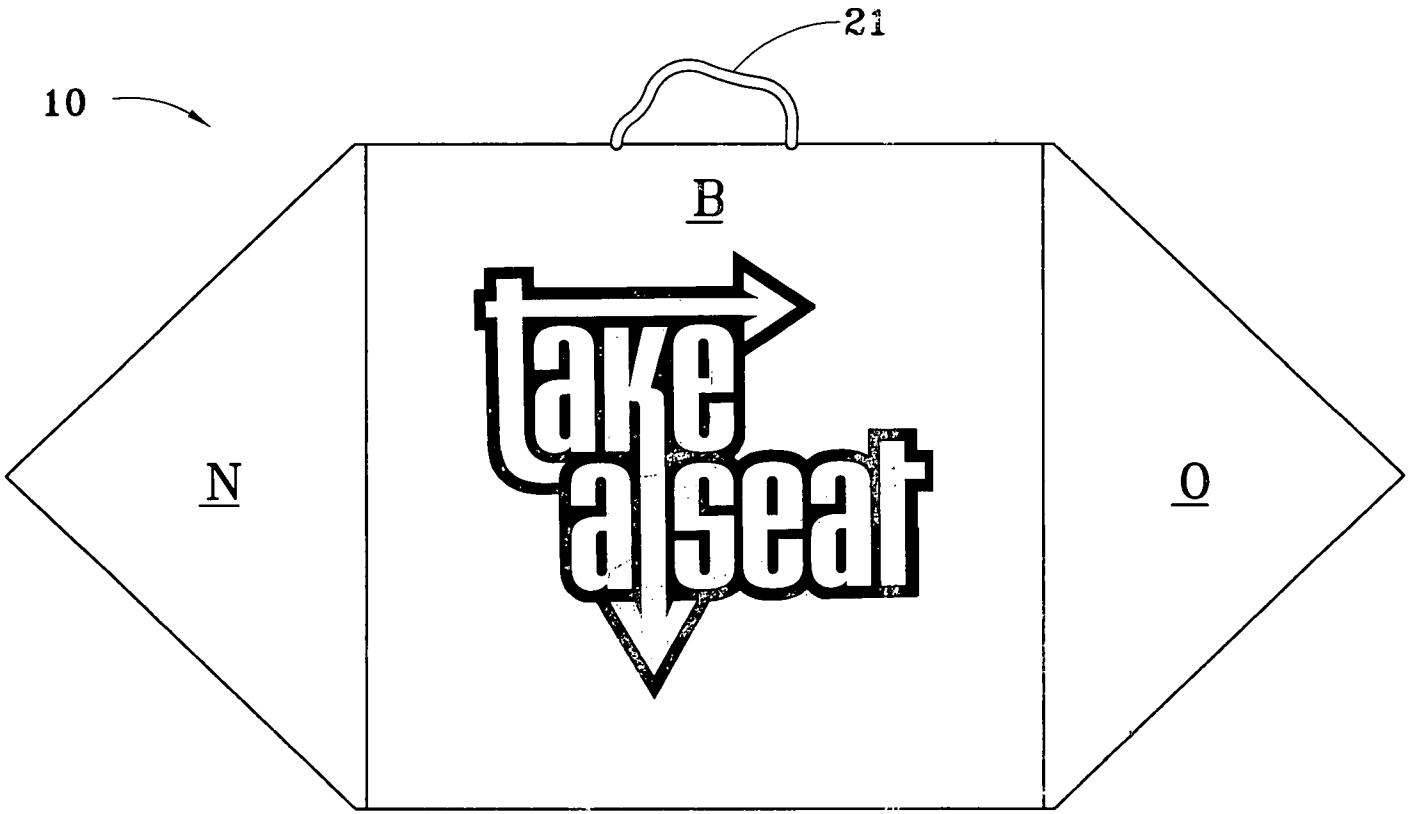

FIGS. 2 through 8 illustrate the manner in which the blank 10 is folded to form a chair. Referring to FIG. 2, underflap panels (V) and (W) are folded onto panel (U) about the seventh and eighth diagonal score lines 82, 84. Panels (P) and (L) are folded about the fifth diagonal score line so that panel (P) overlies panel (N), panel (L) overlies panel (J) and panel (R) overlies panel (A); see FIG. 2. Panel (Q) and panel (M) are folded about the sixth diagonal score line 50 so that panel (Q) overlies panel (O), panel (M) overlies panel (K) and panel (S) overlies panel (A); see FIG. 3. Panel (T) is folded about the upper transverse score line 20 so that panel (T) overlies panel (R) and panel (S), and panel (U), panel (V) and panel (W) all overlie panel (B); see FIG. 4. Panel (F) and panel (G) are simultaneously folded about the left and right longitudinal score lines 14, 16, respectively, so that said panels overlie panel (B), while at the same time panel (A) is folded up to an upstanding position about the central transverse score line 18, thereby causing panel (H) and panel (I) to fold inward and downward about the first and second diagonal score lines 40, 41 and to overlie panel (G) and panel (G), respectively; see FIGS. 5 and 6. Panel (D) is then folded about the left longitudinal score line (16) and panel (E) is folded about the right longitudinal score line (14) so that both panels overlie panel (C); see FIG. 7. Panel (C) [carrying with it underfolded panel (D) and panel (E)] is folded about the lower transverse score line 22 so that said panels overlie panel (B) and then the tab extension 27A of panel (C) is inserted into the slot 91; see FIG. 8. As illustrated in FIG. 9, the chair may be collapsed for carrying or storage by pivoting the back toward the seat, which causes the sides to extend triangularly outward. Handle means 201 may be attached to panel (A) at the upper transverse score line 20 for carrying the chair, which may be something as simple as a loop of cord.

FIG. 10 depicts a pre-cut, pre-scored blank 200 of an alternative embodiment of the invention, comprised of recyclable, planar material, and shown unfolded to a flat conformation. The blank 200 comprises a central, longitudinally-extended body 112 that extends from an central, upper margin 125 to a central, lower margin 127, an upper left chair side/bottom assembly 114 and a lower left chair side/back assembly 180 joined to a left side of the central body 112 along a first longitudinal score line 116, and an upper right chair side/bottom assembly 150 and a lower right chair side/back assembly 198 joined to a right side of the central body 112 along a second longitudinal score line 152. From the top, in descending order, the central body 112 includes a rectangular panel (A) bounded by a first transverse score line 100 that extends from the first longitudinal score line 116 to the second longitudinal score line 152, a central, upper margin 125 parallel to said score line, a left upper cut line 130 that extends from the central, upper margin 125 to the first transverse score line 100 and is collinear with the first longitudinal score line 116, and a right upper cut line 162 that extends from the central, upper margin 125 to the first transverse score line 100 and is collinear with the second longitudinal score line 152; a rectangular panel (B) bounded by the first transverse score line 100, the first and second longitudinal score lines 116, 152, and a second transverse score line 102 that extends from the first longitudinal score line 116 to the second longitudinal score line 152; a rectangular panel (C) bounded by the second transverse score line 102, the first and second longitudinal score lines 116, 152, and a third transverse score line 104 that extends from the first longitudinal score line 116 to the second longitudinal score line 152; a rectangular panel (D) bounded by the third transverse score line 104, the first and second longitudinal score lines 116, 152, and a fourth transverse score line 106, that extends from the first longitudinal score line 116 to the second longitudinal score line 152; a rectangular panel (E) bounded by the fourth transverse score line 106, the first and second longitudinal score lines 116, 152 and a fifth transverse score line 108 that extends from the first longitudinal score line 116 to the second longitudinal score line 152; a rectangular panel (F) bounded by the fifth transverse score line 108, the first and second longitudinal score lines 116, 152 and a sixth transverse score line 110; and a trapezoidal panel (G) bounded by the sixth transverse score line 110, the central, lower margin 127, and beveled left and right sides that joined left and right ends of the sixth transverse score line 110 to left and right ends of the central, lower margin 127, respectively. The distances between the transverse score lines 100, 102, 104, 106, 108, 110 should be such that panels (B) and (C) have substantially equal size, but the longitudinal extent of panels (D) and (E) should be somewhat less and that of panel (F) and panel (G) should be still less.

The upper left chair side/bottom assembly 114 has a boundary that extends diagonally upward and leftward along a lower left margin 120 from the junction 132 of the second transverse score line 102 with the first longitudinal score line, 116 thence along a first outer left margin 122 that extends diagonally from an outer end of the lower margin 120 upward angled slightly rightward to a point that lies on a line of leftward extension of the first transverse score line 100. From thence, the boundary extends rightward along an intermediate left margin 124 that is collinear with the first transverse score line 100 part way toward panel (B). From thence the boundary extends diagonally upward and angled slightly rightward along a second outer left margin 126 a distance about equal to the transverse width of panel (B). From thence, the boundary extends rightward along a left top margin 128 to a point that lines on a line of longitudinal extension of the first longitudinal score line 116, thence downward along the upper left cut line 130.

The upper chair side/bottom assembly 114 is subdivided to include panels (H), (I) (J) and (K). An outer, left, upper triangular panel (H) is bounded by the lower left margin 120, a first diagonal score line 140 that extends upward and leftward from the junction 132 of the second transverse score line 102 with the first longitudinal score line 116 to the first transverse score line 100, and a second diagonal score line 142 that extends from thence to the lower left margin 120. A triangular inner, left, upper panel (I) is bounded by the first diagonal score line 140, the first longitudinal score line 116, and a seventh transverse score line 144. Panel (H) and Panel (I) are each right triangular and share the first diagonal score line 140 as their common hypotenuse. A trapezoidal left seat back tab panel (J) is bounded by the first outer left margin 122, the intermediate left margin 124, the second diagonal score line 142, and the lower left margin 120. A trapezoidal, intermediate left seat/back panel (K) is bounded by the second outer left margin 126, the left top margin 128, the upper left cut line 130, and the seventh transverse score line 144.

The upper right chair side/bottom assembly 150 has a boundary that extends diagonally upward and rightward along a lower right margin 154 from the junction 136 of the second transverse score line 102 with the second longitudinal score line 152, thence along a lower a first outer right margin 156 that extends diagonally from an outer end of said lower margin 154 upward angled slightly leftward to a point that lines on a line of rightward extension of the first transverse score line 100; thence leftward along an intermediate right margin 158 collinear with the first transverse score line 100 part way toward panel (B), thence diagonally upward and angled slightly leftward along a second outer right margin 160 a distance about equal to the transverse width of panel (B), thence leftward along a left top margin 172 to a point that lies on a line of longitudinal extension of the second longitudinal score line 152, thence downward along the upper right cut line 162, said cut line having a lower terminus at the first transverse score line 100; thence along the second longitudinal score line 152 to the junction 136 of the second transverse score line 102 with the second longitudinal score line 152.

The upper right chair side/bottom assembly 150 is subdivided to include panels (L), (M), (N) and (O). A triangular outer, right upper panel (L) is bounded by the lower right margin 154, a fifth diagonal score line 164 that extends upward and rightward from the junction 136 of the second transverse score line 102 with the second longitudinal score line 152 to the first transverse score line 100 at the junction of the intermediate right margin 158 with the second outer right margin 160, and a sixth diagonal score line 166 that extends from said junction to the lower right margin 154. A triangular inner, right upper panel (M) is bounded by the fifth diagonal score line 164, the second longitudinal score line 152, and an eighth transverse score line 168. Panel (L) and Panel (M) are each right triangular and share the fifth diagonal score line 164 as their common hypotenuse. A trapezoidal right seat back tab panel (N) is bounded by the first outer right margin 156, the intermediate right margin 124, the sixth diagonal score line 166, and the lower right margin 154. A trapezoidal, intermediate right seat back panel (O) is bounded by the second outer right margin 160, the right top margin 172, the upper right cut line 162, and the eighth transverse score line 168.

The lower left chair side/bottom assembly 180 is joined to a left end of the panel (C) at the first longitudinal score line 116 from the second transverse score line 102 to the third transverse score line 104, extends leftward from said panel (C), and includes panels (P) and (Q). The triangular, lower left panel (P) is bounded by the first longitudinal score line 116, a ninth transverse score line 181 collinear with the third transverse score line 104 and extending leftward therefrom a distance about equal to the length of the left top margin 128, and a left diagonal margin 182 that extends from the leftmost extremity of the ninth transverse score line to the junction 132 of the second transverse score line 102 with the first longitudinal score line 116. Trapezoidal, lower left flap panel (Q) has an upper end joined to a lower end of panel (P) at the ninth transverse score line 181, a left margin 186 that extends from the junction of the ninth transverse score line 181 with the left diagonal margin 182 downward below the level of the fourth transverse score line 106 but well above the level of the fifth transverse score line 108, a longitudinally-directed lower left cut line 188 that extends about the same length as the left margin 186 below the fourth transverse score line 106, and a left bottom end that extends leftward from the lowermost point of said cut line 188 to the lowermost point of said left margin 186.

The lower right chair side/bottom assembly 180 is joined to a right end of the panel (C) at the second longitudinal score line 152 from the second transverse score line 102 to the third transverse score line 104, extends rightward from said panel (C), and includes panels (R) and (S). The triangular, lower right panel (R) is bounded by the second longitudinal score line 152, a tenth transverse score line 190 collinear with the third transverse score line 104 and extending rightward therefrom a distance about equal to the length of the right top margin 172, and a right diagonal margin 192 that extends from the rightmost extremity of the tenth transverse score line 190 to the junction 136 of the second transverse score line 102 with the second longitudinal score line 152. Trapezoidal, lower right flap panel (S) has an upper end joined to a lower end of panel (R) at the tenth transverse score line 190, a right margin 194 that extends from the junction of the tenth transverse score line 190 with the right diagonal margin 192 downward below the level of the fourth transverse score line 106 but well above the level of the fifth transverse score line 108, a longitudinally-directed lower right cut line 196 that extends about the same length as the right margin 194 below the fourth transverse score line 106, and a right bottom end that extends rightward from the lowermost point of said cut line 196 to the lowermost point of said right margin 194. Panel (P) and panel (R) are right triangular and congruent, and their maximum longitudinal extent equals that of panel (C). Panel (H) is congruent to panel (L) and panel (I) is congruent to panel (M). Likewise, panel (Q) is equal in size to panel (S); panel (J) is equal in size to panel (N); and panel (K) is equal in size to panel (O). As shown by parallel dashed lines in FIG. 10, preferably the fifth transverse score line 108, the first diagonal score line 140 and the fifth diagonal score line 164 are each double score lines, and the fourth transverse score line is a triple score line.

Figure 21:
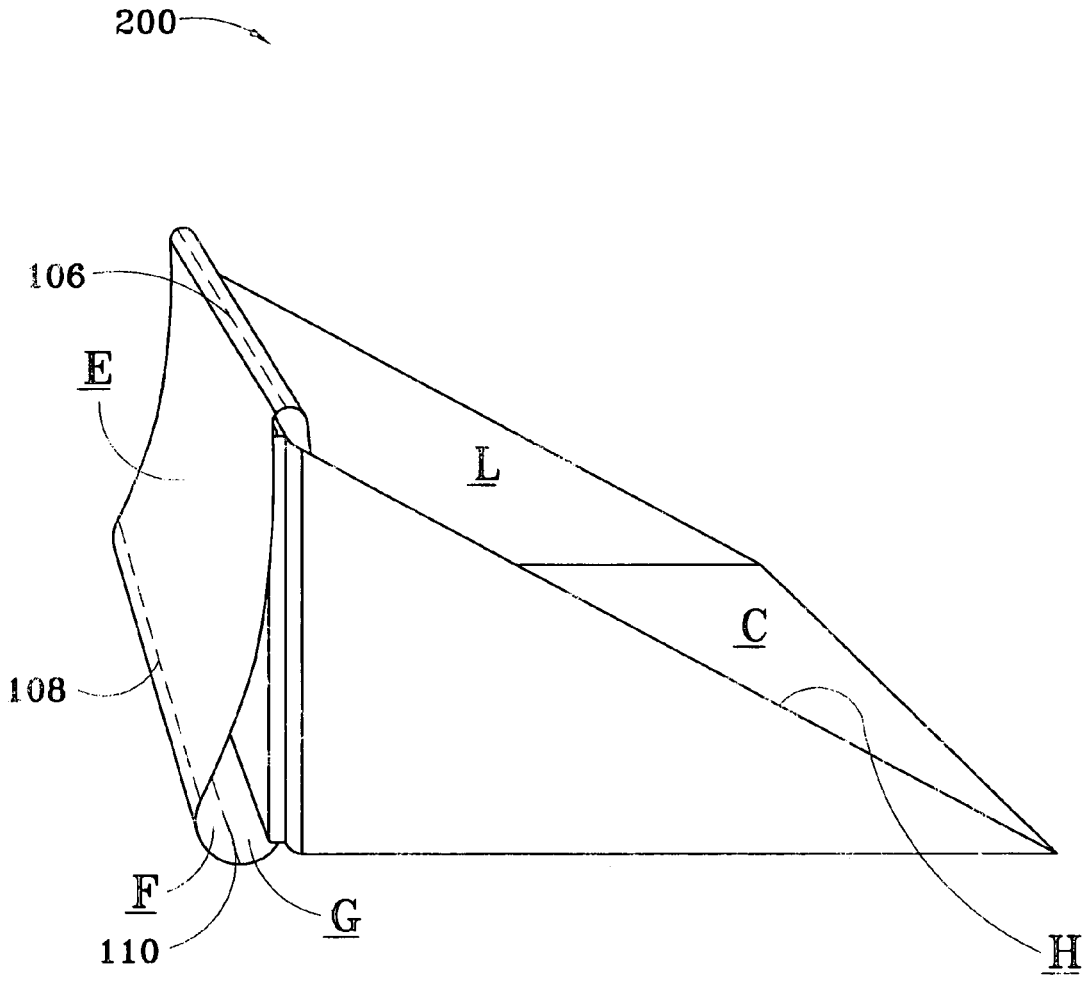
FIG. 21 is side perspective view thereof showing panels (F) and (G) being tucked up in between panels (A) and (K)
Figure 22:
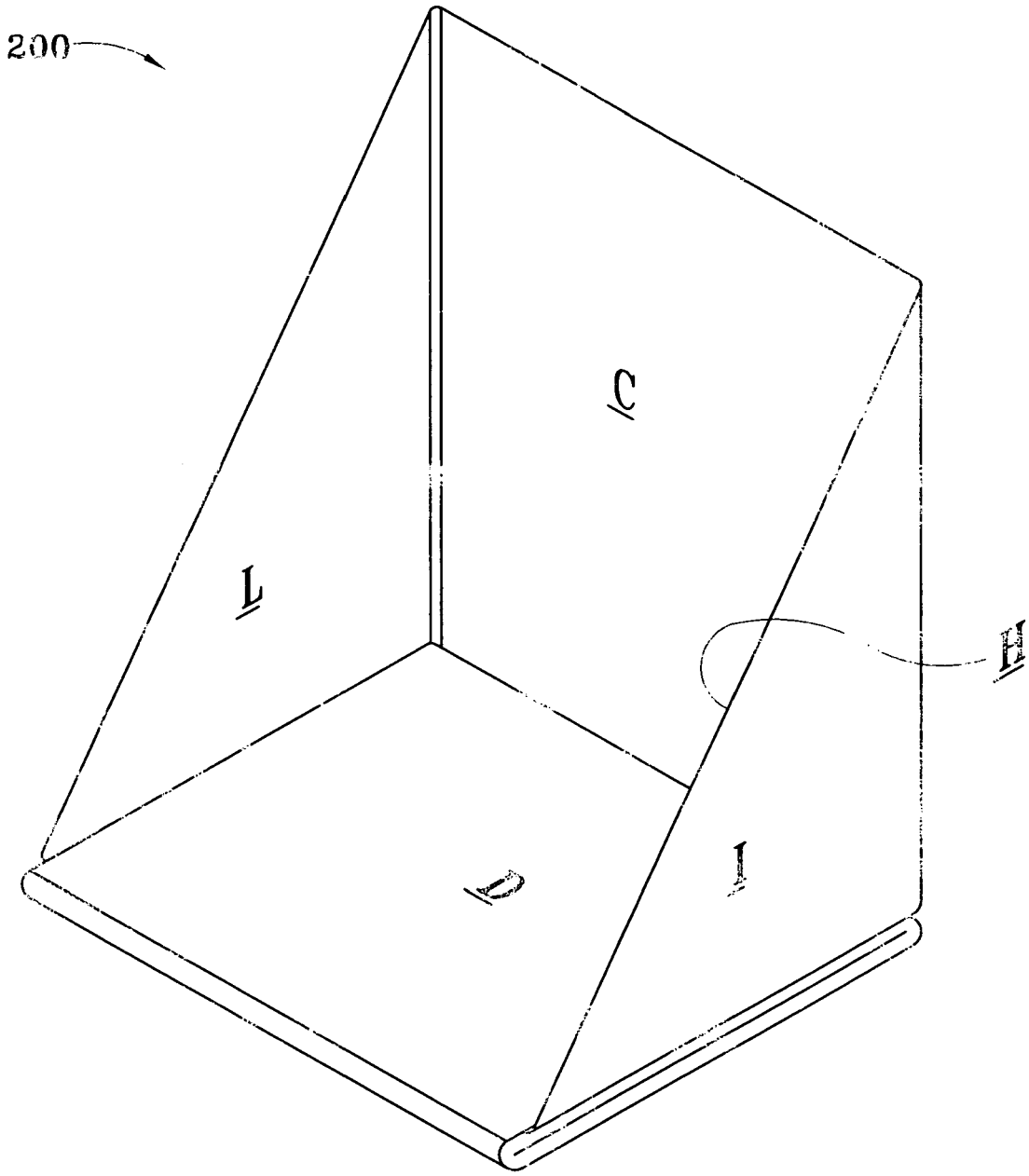
FIG. 22 is a frontal perspective view thereof, after completion of the step shown in FIG. 21, showing the complete conversion of the blank into a collapsible chair in an open, extended position.
Figure 23:
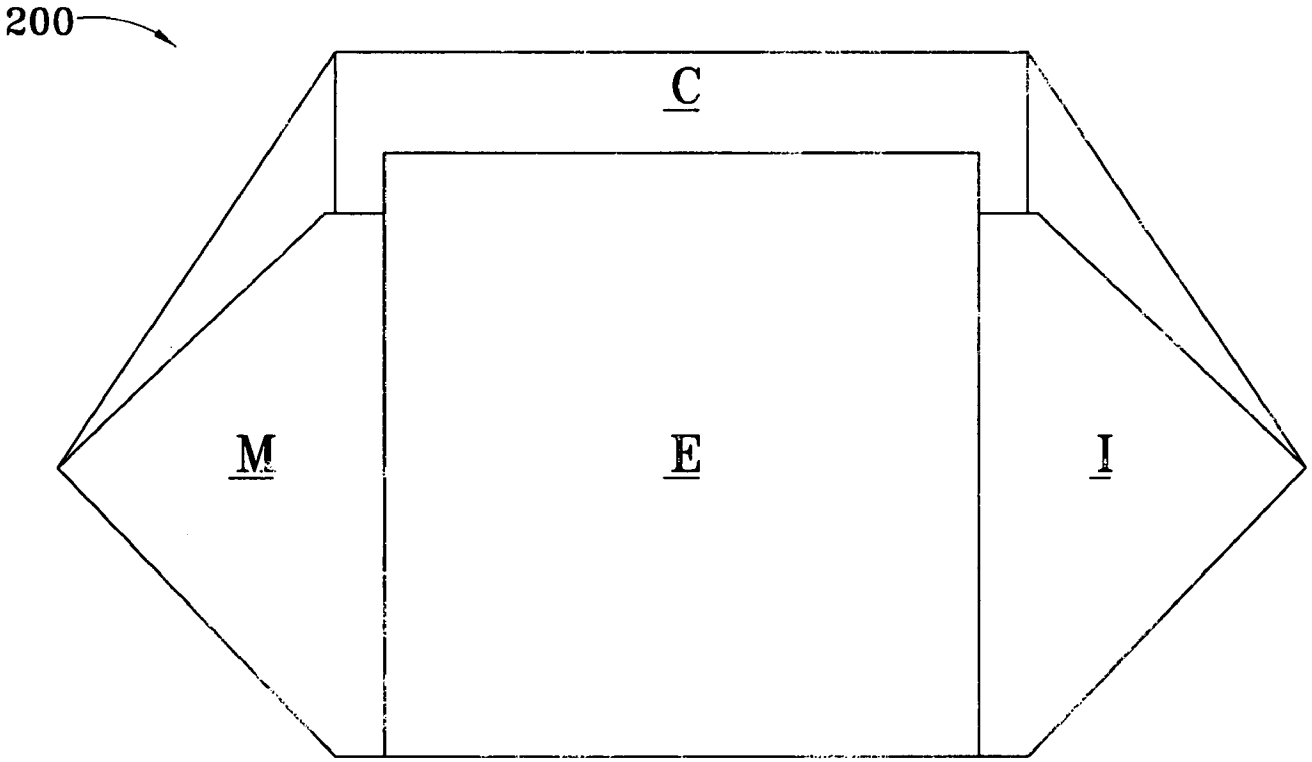
FIG. 23 is a side elevational perspective view of the chair of FIG. 20 shown partially collapsed.

The manner of folding the blank 200 is illustrated in FIGS. 11-20. Starting with the blank 200 laid completely unfolded and flat, the entire portion of the body that lies below the second transverse score line 102 is folded about said score line 102 so that panel (C) overlies panel (B), panel (P) overlies panel (I), panel (Q) overlies panel (K), panel (R) overlies panel (M), panel (S) overlies panel (O) and panel (D) overlies panel (A); see FIG. 11. Next, the portion of the central body 112 that lies below the third score line 104 is folded about said score line 104 so that panel (D) overlies panel (C); see FIG. 12. Then, panel (H) is folded about the first diagonal score line 140 so that panel (H) overlies panel (P) and panel (J) partially overlies panel (Q); see FIG. 13. Next, panel (L) is folded about the fifth diagonal score line 164 so that panel (L) overlies panel (R) and panel (N) partially overlies panel (S); see FIG. 14. Next, panel (P), which lies below panel (H), is folded about the first longitudinal score line 116 to an upstanding position, which thereby also raises panels (I), (J), (K) and (Q) to an upstanding position. Then, panel (R), which lies below panel (L), is similarly folded about the second longitudinal score line 152 to an upstanding position, which thereby also raises panels (M), (N), (O), (R) and (S) to an upstanding position; see FIG. 15. Next, panel (J) is folded inward about the second diagonal score line 142 and panel (N) is folded inward about the sixth diagonal score line 166 so that the their respective outer margins 122, 170 are in mating engagement above the first transverse score line 100; see FIG. 16. Then, panel (Q) is folded about the ninth transverse score line 181 behind and adjacent to panels (J) and (N); see FIGS. 16 and 17. Next, panel (S) is folded about the tenth transverse score line 190 behind and adjacent panel (Q); see FIGS. 16, 17 and 18. Then, panel (A) is folded up about the first transverse score line 100 behind and adjacent to panel (S); see FIG. 18. Next, panel (K) is folded about the seventh transverse score line (144) behind and adjacent to panel (A) and panel (O) is folded about the eighth transverse score line (168) behind and adjacent to panel (K); see FIGS. 19 and 20. Next, panel (D) is folded about the third transverse score line (104) so that panel (D) overlies panel panels (J) and (N), and panel (E) is folded about the fourth transverse score line 106 so that panel (E) is behind and adjacent to panel (O); see FIG. 20. Lastly, panels (G) and (F) are tucked between panels (K) and (O), which maneuver is facilitated by the beveled sides of panel (G); see FIGS. 20 and 21. This folding sequence converts the blank 200 into a recyclable event chair in an open, sitting position, as depicted in FIG. 22. By pivotal rotation of the seat of the chair about the third transverse score line 104 toward the back of the chair, the chair can be collapsed as depicted in FIG. 23, wherein the sides of the chair move triangularly outward. Thus, the chair 200 of the second embodiment of the invention is capable of the same bellows-type opening and collapsing motions as that of the first embodiment.

From the foregoing description, it will be clear that the present invention may be embodied in other specific forms without departing from the spirit or essential characteristics thereof. It will be understood, for instance, that in the folding of the blank 200 of the second embodiment, the folding of panel (K) behind panel (A) can either precede or follow the folding of panel (O) behind panel (A). As another example, the flange panels (X) and (Y) of the first embodiment of the invention are desirable for user comfort and for durability of the chair, but could be eliminated. As a further example, although certain fold lines in the illustrated embodiments are denoted as double or triple score lines, fewer or additional fold lines may need to be double or triple score lines depending primarily upon the thickness and pliability of the planar material chosen for the blank; accordingly, in the claims, each recitation of the term "score line" is intended to include the possibilities of a single, double or triple score line, whichever may be deemed suitable or necessary by persons of ordinary skill in the relevant arts for the particular thickness and pliability of the planar material chosen for the blank. Thus, the presently disclosed embodiments are therefore to be considered in all respects as illustrative and not restrictive, the scope of the invention being indicated by the appended claims, and not limited to the foregoing description.

I claim:

1. A pre-cut, pre-scored blank for a chair foldable between a closed, collapsed storage position and an open, extended sitting position, comprising:

a foldable, longitudinally-elongated body (10) that is corner-truncated but of otherwise generally rectangular outline that, when completely unfolded to a flat conformation, extends longitudinally from an upper end margin (25) to an opposite lower end margin (27) and transversely from a left margin (29) to a right margin (31), said body having left and right, transversely spaced-apart and longitudinally-extended score lines (14, 16) that divide the body longitudinally into three longitudinally-extended sections of about equal transverse width; a central transverse score line (18); an upper transverse score line (20) and a lower transverse score line (22) longitudinally spaced-apart above and below the central score line (18), respectively; upper left and right cut lines (30, 32) collinear with the left and right score lines (16, 14) that extend from the upper transverse score line (20) at least part way to the upper margin (25); lower left and right transverse cut lines (70, 72) collinear with the lower, transverse score line (22) that extend from the left and right margins (29, 31) to the left and right longitudinal score lines (14, 16), respectively; a first diagonal score line (40) that extends from the intersection (36) of the central, transverse score line (18) with the left longitudinal score line to the nearest portion (41) of the lower left cut line (70); a second diagonal score line (42) that extends from the intersection (38) of the central, transverse score line (18) with the right longitudinal score line (14) to the nearest portion (43) of the lower right cut line (72); a third diagonal score line (44) that extends from the intersection (36) of the central, transverse score line (18) with the left longitudinal score line (16) to the intersection (52) of the left margin (29) with the upper transverse score line (20); a fourth diagonal score line (46) that extends from the intersection (38) of the central, transverse score line (18) with the right longitudinal score line (14) to the intersection (58) of the upper transverse score line (20) with the right margin (31); a fifth diagonal score line (48) that extends from the intersection (60) of the upper transverse score line with the left longitudinal score line (16) to the intersection (62) of the central transverse score line (18) with the left margin (29); a sixth diagonal score line (50) that extends from the intersection (54) of the upper transverse score line (20) with the right longitudinal score line (14) to the intersection (56) of the central transverse score line (18) with the right margin (31);

wherein said score lines define a plurality of panels, adjacent ones of said panels being foldable about said score lines with respect to one another, said panels including (a) a rectangular outer back panel (A) bounded by the central transverse score line (18), the upper transverse score line (20), and the left and right longitudinal score lines (16, 14);

(b) a rectangular seat base panel (B) bounded by the lower transverse score line (22), the central transverse score line (18), and the left and right longitudinal score lines (16, 14);

(c) a rectangular seat cover panel (C) bounded by the lower margin (27), the lower transverse score line (22), and the left and right longitudinal score lines (16, 14);

(d) a rectangular left cover flange panel (D) bounded by the lower margin (27), the left margin (29), the lower left cut line (70) that is collinear with the lower transverse score line (22), and the left longitudinal score line (16);

(e) a rectangular, right cover flange panel (E) bounded by the lower margin (27), the right margin (31), a lower right cut line (72) that is collinear with the lower transverse score line (22), and the right longitudinal score line (14);

(f) a trapezoidal, lower left seat liner panel (F) bounded by the left lower cut line (70) that is collinear with the lower transverse score line (22), the left margin (29), the first diagonal score line (40) and the left longitudinal score line (16);

(g) a trapezoidal lower right seat liner panel (G) bounded by the lower right cut line (72) that is collinear with the lower transverse score line (22), the right margin (31), the second diagonal score line (42) and the right longitudinal score line (14);

(h) a trapezoidal upper left seat liner panel (H) bounded by the left margin (29), the central transverse score line (18), and the first diagonal score line (40);

(i) a trapezoidal upper right seat liner panel (I) bounded by the right margin (31), the central transverse score line (18), and the second diagonal score line (42);

(j) a triangular outer left side panel (J) bounded by the left longitudinal score line (16), the third diagonal score line (44), and the fifth diagonal score line (48);

(k) a triangular outer right side panel (K) bounded by the right longitudinal score line (14), the fourth diagonal score line (46), and the sixth diagonal score line (50);

(l) a triangular, upper, inner left side panel (L) bounded by the upper transverse score line (20), the third diagonal score line (44), and the fifth diagonal score line (48);

(m) a triangular, upper, inner right side panel (M) bounded by the upper transverse score line (20), the fourth diagonal score line (46), and the sixth diagonal score line (50);

(n) a triangular, lower, outer left side panel (N) bounded by the central transverse score line (18), the third diagonal score line (44), and the fifth diagonal score line (48);

(o) a triangular, lower, outer right side panel (O) bounded by the central transverse score line (18), the fourth diagonal score line (46), and the sixth diagonal score line (50);

(p) a triangular, lower, inner left side panel (P) bounded by the left margin (29), the third diagonal score line (44), and the fifth diagonal score line (48);

(q) a triangular, lower, inner right side panel (Q) bounded by the right margin (31), the fourth diagonal score line (46), and the sixth diagonal score line (50);

(r) a rectangular, left upper flap panel (R) bounded by the upper transverse score line (20), the left margin (29), the upper margin (25) and the left, upper cut line (30);

(s) a rectangular, right upper flap panel (S) bounded by the upper transverse score line (20), the right margin (31), the upper margin (25), and the right, upper cut line (32);

(t) a rectangular, inner back panel (T) bounded by the upper transverse score line (20), the left, upper cut line (30) and collinear portion of the left margin (29), a top transverse score line (80), and the right, upper cut line (32) and collinear portion of the right margin (31);

(u) a trapezoidal rear seat top panel (U) joined to an upper portion of the inner back panel (T) along the top transverse score line (80), said panel (U) being bounded by said top transverse score line (80), the top margin (25), a seventh diagonal score line (82) that extends upward and rightward from the intersection (86) of the top transverse score line (80) with the left margin (29) to the top margin (25), and an eighth diagonal score line (84) that extends upward and leftward from the intersection (90) of the top transverse score line (80) with the right margin (31) to the top margin (25);

(v) a triangular left rear seat top underflap panel (V) joined to the rear seat top panel (U) along the seventh diagonal score line (82), said panel (V) being bounded by said top seventh diagonal score line (82), the left margin (29) and the top margin (25); and (w) a triangular right rear seat top underflap panel (W) joined to the rear seat top panel (W) along the eighth diagonal score line (84), said panel (W) being bounded by said eighth diagonal score line (84), and the top margin (25).

2. The blank of claim 1, wherein the inner back panel (T) is substantially equal in size to the outer back panel (A).

3. The blank of claim 2, wherein an insert slot (91) is centrally disposed along the top transverse score line (80) and further comprising a tab extension (27A) on the lower margin (27) adapted for insertion and retention within said slot (91).

4. The blank of claim 3, further comprising a trapezoidal lower, inner left side flange panel (X) joined to a left portion of the lower, inner left side panel (P) at a third longitudinal score line (92), and a trapezoidal lower, inner right side flange panel (Y) joined to a right portion of the lower, inner right side panel (Q) at a fourth longitudinal score line (94), wherein each of said flange panels (X, Y) extends longitudinally a distance coextensive with the panels (P, Q) to which they are joined, and said panels (X, Y) have diagonal top margins (52, 58) parallel to the fifth and fourth diagonal score lines (48, 46), respectively.

5. The blank of any of one claim 1, 2, 3, or 4, wherein the blank consists of double-wall corrugated fiber-board.

6. The blank of claim 5, further comprising handle means attached to the outer back (A) at the upper, transverse score line (20).

7. A method for folding the blank of claim 1 or 2 to form a chair, comprising the steps of:

folding the left rear seat top underflap panel (V) and the right rear seat top underflap panel (W) about the seventh and eighth diagonal score lines (82, 84), respectively, so that said panels overlie the rear seat top (U);

then folding the lower, inner left side panel (P) and the upper, inner left side panel (L) about the fifth diagonal score line (48) so that the lower, inner left side panel (P) overlies the lower, outer left side panel N, the upper, inner left side panel (L) overlies the outer left side panel (J), and the left upper flap panel (R) overlies the outer back panel (A);

then folding the lower, inner right side panel (Q) and the upper, inner right side panel (M) about the sixth diagonal score line (50) so that the lower, inner right side panel (Q) overlies the lower, outer right side panel (O), the upper, inner right side panel (M) overlies the outer right side panel K, and the right upper flap panel (S) overlies the outer back panel (A);

then folding the inner back panel (T) about the upper transverse score line (20) so that the inner back panel (T) overlies the left and right upper flaps (R, S) and the rear seat top panel (U), and the left and right rear seat top underflap panels (V, W) overlie the seat base panel (B);

then simultaneously folding the left and right trapezoidal seat liner panels (F) and (G) about the left and right longitudinal score lines (16, 14), respectively, so that said panels overlie the seat base panel (B), while at the same time folding the outer back (A) to an upstanding position about the central transverse score line (18), thereby causing the upper left and right seat liner panels (H, I) to fold inward and downward about the first and second diagonal score lines (40, 42) to overlie the panels (F) and (G), respectively;

then folding the left cover flange panel (D) about the left longitudinal score line (16) and the right cover flange panel (E) about the right longitudinal score line (14) to overlie the seat cover panel (C); and then folding the seat cover panel (C), left cover flange panel (D), and right cover flange panel (E) about the lower transverse score line (22) so that said panels overlie the seat base panel.

8. A method for folding the blank of claim 3 to form a chair, comprising the steps of:

folding the left rear seat top underflap panel (V) and the right rear seat top underflap panel (W) about the seventh and eighth diagonal score lines (82, 84), respectively, so that said panels overlie the rear seat top (U);

then folding the lower, inner left side panel (P) and the upper, inner left side panel (L) about the fifth diagonal score line (48) so that the lower, inner left side panel (P) overlies the lower, outer left side panel (N), the upper, inner left side panel (L) overlies the outer left side panel (J), and the left upper flap panel (R) overlies the outer back panel (A);

then folding the lower, inner right side panel (Q) and the upper, inner right side panel (M) about the sixth diagonal score line (50) so that the lower, inner right side panel (Q) overlies the lower, outer right side panel (O), the upper, inner right side panel (M) overlies the outer right side panel K, and the right upper flap panel (S) overlies the outer back panel (A);

then folding the inner back panel (T) about the upper transverse score line (20) so that the inner back panel (T) overlies the left and right upper flaps (R, S) and the rear seat top panel (U), and the left and right rear seat top underflap panels (V, W) overlie the seat base panel (B);

then simultaneously folding the left and right trapezoidal seat liner panels (F) and (G) about the left and right longitudinal score lines (16, 14), respectively, so that said panels overlie the seat base panel (B), while at the same time folding the outer back (A) to an upstanding position about the central transverse score line (18), thereby causing the upper left and right seat liner panels (H, I) to fold inward and downward about the first and second diagonal score lines (40, 42) to overlie the panels (F) and (G), respectively;

then folding the left cover flange panel (D) about the left longitudinal score line (16) and the right cover flange panel (E) about the right longitudinal score line (14) to overlie the seat cover panel (C); and then folding the seat cover panel (C), left cover flange panel (D), and right cover flange panel (E) about the lower transverse score line (22) so that said panels overlie the seat base panel (B); and then inserting the tab extension (27A) into the slot (91).

9. A method for folding the blank of claim 4 to form a chair, comprising the steps of:

folding the left rear seat top underflap panel (V) and the right rear seat top underflap panel (W) about the seventh and eighth diagonal score lines (82, 84), respectively, so that said panels overlie the rear seat top (U);

then folding the lower, inner left side panel (P) and the upper, inner left side panel (L) about the fifth diagonal score line (48) so that the lower, inner left side panel (P) overlies the lower, outer left side panel (N), the upper, inner left side panel (L) overlies the outer left side panel (J), and the left upper flap panel (R) overlies the outer back panel (A);

then folding the lower, inner right side panel (Q) and the upper, inner right side panel (M) about the sixth diagonal score line (50) so that the lower, inner right side panel (Q) overlies the lower, outer right side panel (O), the upper, inner right side panel (M) overlies the outer right side panel (K), and the right upper flap panel (S) overlies the outer back panel (A);

then folding the inner back panel (T) about the upper transverse score line (20) so that the inner back panel (T) overlies the left and right upper flaps (R, S) and the rear seat top panel (U), and the left and right rear seat top underflap panels (V, W) overlie the seat base panel (B);

then simultaneously folding the left and right trapezoidal seat liner panels (F) and (G) about the left and right longitudinal score lines (16, 14), respectively, so that said panels overlie the seat base panel (B), while at the same time folding the outer back (A) to an upstanding position about the central transverse score line (18), thereby causing the upper left and right seat liner panels (H, I) to fold inward and downward about the first and second diagonal score lines (40, 42) to overlie the panels (F) and (G), and the lower, inner left side flange panel (X) and the lower, inner right side flange panel (Y) to overlie the upper left and right seat liner panels (H, I), respectively;

then folding the left cover flange panel (D) about the left longitudinal score line (16) and the right cover flange panel (E) about the right longitudinal score line (14) to overlie the seat cover panel (C);

then folding the seat cover panel (C), left cover flange panel (D), and right cover flange panel (E) about the lower transverse score line (22) so that said panels overlie the seat base panel (B); and then inserting the tab extension (27A) into the slot (91).

* * * * *